US009943943B2

(12) United States Patent
Shinozaki et al.

(10) Patent No.: US 9,943,943 B2
(45) Date of Patent: Apr. 17, 2018

(54) METHOD AND APPARATUS FOR MONITORING A POLISHING SURFACE OF A POLISHING PAD USED IN POLISHING APPARATUS

(71) Applicant: EBARA CORPORATION, Tokyo (JP)

(72) Inventors: Hiroyuki Shinozaki, Tokyo (JP); Takahiro Shimano, Tokyo (JP); Akira Imamura, Tokyo (JP); Akira Nakamura, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 0 days.

(21) Appl. No.: 15/051,928

(22) Filed: Feb. 24, 2016

(65) Prior Publication Data

US 2016/0207162 A1 Jul. 21, 2016

Related U.S. Application Data

(62) Division of application No. 14/800,896, filed on Jul. 16, 2015, now Pat. No. 9,302,366, which is a division
(Continued)

(30) Foreign Application Priority Data

Jun. 2, 2011 (JP) ..... 2011-124057

(51) Int. Cl.
*B24B 49/02* (2006.01)
*B24B 49/04* (2006.01)
(Continued)

(52) U.S. Cl.
CPC ..... *B24B 37/005* (2013.01); *B24B 37/042* (2013.01); *B24B 49/02* (2013.01);
(Continued)

(58) Field of Classification Search
CPC ..... B24B 37/005; B24B 37/042; B24B 49/02; B24B 49/04; B24B 49/18; B24B 49/183;
(Continued)

(56) References Cited

U.S. PATENT DOCUMENTS 5,531,635 A 7/1996 Mogi et al.
5,618,447 A 4/1997 Sandhu
(Continued)

FOREIGN PATENT DOCUMENTS

JP 54-127090 10/1979
JP 7-237113 9/1995
(Continued)

*Primary Examiner* — Eileen Morgan
(74) *Attorney, Agent, or Firm* — Wenderoth, Lind & Ponack, L.L.P.

(57) ABSTRACT

A method is capable of monitoring the polishing surface of the polishing pad without removing the polishing pad from the polishing table. The method includes: conditioning the polishing surface of the polishing pad by causing a rotating dresser to oscillate on the polishing surface; measuring a height of the polishing surface when the conditioning of the polishing surface is performed; calculating a position of a measuring point of the height on a two-dimensional surface defined on the polishing surface; and repeating the measuring of the height of the polishing surface and the calculating of the position of the measuring point to create height distribution in the polishing surface.

19 Claims, 20 Drawing Sheets

Related U.S. Application Data of application No. 13/479,575, filed on May 24, 2012, now Pat. No. 9,156,122.

(51) Int. Cl.

| | |
|---|---|
| ***B24B 49/18*** | (2006.01) |
| ***B24B 53/017*** | (2012.01) |
| ***B24B 37/005*** | (2012.01) |
| ***B24B 53/08*** | (2006.01) |
| ***B24B 53/00*** | (2006.01) |
| ***B24B 37/04*** | (2012.01) |

(52) U.S. Cl.

CPC ..... *B24B 49/04* (2013.01); *B24B 49/18* (2013.01); *B24B 49/186* (2013.01); *B24B 53/005* (2013.01); *B24B 53/017* (2013.01); *B24B 53/08* (2013.01)

(58) Field of Classification Search

CPC ... B24B 49/186; B24B 53/005; B24B 53/017; B24B 53/02; B24B 53/12

USPC ..... 451/9, 10, 11, 56, 443

See application file for complete search history.

(56) References Cited

U.S. PATENT DOCUMENTS 5,655,951 A * 8/1997 Meikle ..... B24B 49/12 451/41
5,664,987 A 9/1997 Rentein
5,708,506 A 1/1998 Birang
5,875,559 A 3/1999 Birang et al.
6,120,349 A * 9/2000 Nyui ..... B24B 37/005 451/21
6,186,864 B1 2/2001 Fisher et al.
6,194,231 B1 2/2001 Ho-Cheng et al.
6,270,396 B1 8/2001 Uchiyama
6,336,842 B1 1/2002 Ootsuki et al.
6,905,400 B2 * 6/2005 Kimura ..... B24B 37/005 451/286
7,201,632 B2 4/2007 Elledge
7,258,596 B2 * 8/2007 Elledge ..... B24B 1/04 451/56
7,306,506 B2 12/2007 Elledge
8,043,870 B2 10/2011 Manens et al.
8,070,557 B2 12/2011 Kojima et al.
8,083,571 B2 12/2011 Nabeya et al.
8,142,261 B1 3/2012 Sung
8,152,594 B2 4/2012 Saito et al.
8,221,193 B2 * 7/2012 Chang ..... B24B 37/042 451/5
8,257,143 B2 9/2012 Katsuoka et al.
9,138,860 B2 * 9/2015 Dhandapani ..... B24B 53/017
9,156,122 B2 * 10/2015 Shinozaki ..... B24B 37/042
9,302,366 B2 * 4/2016 Shinozaki ..... B24B 37/042
2004/0192168 A1 * 9/2004 Faustmann ..... B24B 49/02 451/5
2006/0166503 A1 7/2006 Sasaki et al.
2006/0260745 A1 * 11/2006 Tanaka ..... B24B 37/26 156/345.13
2009/0036024 A1 * 2/2009 Matsuzaki ..... B24B 37/013 451/5
2009/0104847 A1 * 4/2009 Kobayashi ..... B24B 37/042 451/5
2009/0137190 A1 * 5/2009 Togawa ..... B24B 37/013 451/8
2010/0075577 A1 3/2010 Kojima et al.
2011/0256812 A1 * 10/2011 Dhandapani ..... B24B 53/017 451/56
2012/0064800 A1 * 3/2012 Watanabe ..... B24B 37/005 451/5
2014/0120724 A1 5/2014 Sung
2014/0287653 A1 * 9/2014 Shimano ..... B24B 37/005 451/5
2014/0342642 A1 * 11/2014 Shimano ..... B24B 53/005 451/72

FOREIGN PATENT DOCUMENTS

| | | |
|---|---|---|
| JP | 10-86056 | 4/1998 |
| JP | 11-277405 | 10/1999 |
| JP | 2001-334461 | 12/2001 |
| JP | 2006-93296 | 4/2006 |
| JP | 2006-255851 | 9/2006 |
| JP | 2008-207320 | 9/2008 |
| JP | 2008-246619 | 10/2008 |
| JP | 2008-284645 | 11/2008 |
| JP | 2009-12164 | 1/2009 |
| JP | 4259048 | 2/2009 |
| JP | 2009-148877 | 7/2009 |
| KR | 10-2010-0120625 | 11/2010 |
| TW | 200819243 | 5/2008 |

* cited by examiner

METHOD AND APPARATUS FOR MONITORING A POLISHING SURFACE OF A POLISHING PAD USED IN POLISHING APPARATUS

CROSS REFERENCE TO RELATED APPLICATIONS

This document claims priority to Japanese Application Number 2011-124057, filed Jun. 2, 2011, the entire contents of which are hereby incorporated by reference.

BACKGROUND OF THE INVENTION

Field of the Invention

The present invention relates to a method and an apparatus for monitoring a polishing surface of a polishing pad during conditioning of the polishing pad.

Description of the Related Art

A polishing apparatus, as typified by CMP apparatus, is designed to polish a surface of a substrate by providing relative movement between a polishing pad and the surface of the substrate while supplying a polishing liquid onto the polishing pad attached to a polishing table. In order to maintain polishing performance of the polishing pad, it is necessary to condition (or dress) a polishing surface of the polishing pad regularly by a dresser.

The dresser has a dressing surface to which diamond particles are fixed in its entirety. This dresser has a dressing disk which is removable, and a lower surface of the dressing disk provides the dressing surface. The dresser is configured to rotate about its own axis and press the polishing surface of the polishing pad, while moving on the polishing surface. The rotating dresser scrapes away the polishing surface of the polishing pad slightly to thereby restore the polishing surface.

An amount (i.e., a thickness) of the polishing pad removed by the dresser per unit time is called a cutting rate. It is preferable that the cutting rate be uniform over the polishing surface of the polishing pad in its entirety. In order to obtain an ideal polishing surface, it is necessary to perform recipe tuning of pad conditioning. In this recipe tuning, rotating speed and moving speed of the dresser, load of the dresser on the polishing pad, and other conditions are adjusted.

Whether or not the pad conditioning is performed properly is evaluated based on whether or not a uniform cutting rate is achieved over the polishing surface in its entirety. In the recipe tuning, the polishing pad is actually conditioned by the dresser for several hours and a profile of the polishing pad (i.e., a cross-sectional shape of the polishing surface) is obtained. The cutting rate can be calculated from the profile obtained, an initial profile, and a conditioning time.

The profile of the polishing pad is obtained by removing the polishing pad from the polishing table and measuring thickness of the polishing pad at multiple measuring points. However, these procedures are repeated until a uniform cutting rate is obtained. Therefore, a lot of polishing pads are consumed in the recipe tuning. As a size of the substrate becomes larger, a size of the polishing pad also becomes larger. As a result, a unit cost of the polishing pad also becomes high. That is, the recipe tuning of the pad conditioning requires not only a lot of time but also a lot of cost.

The purpose of the pad conditioning is to restore the polishing surface of the polishing pad and to form a flat polishing surface. However, during conditioning of the polishing pad, the dresser may be caught by (i.e., stumble over) the polishing surface of the polishing pad, scraping away the polishing pad greatly in some parts of the polishing pad. The polishing pad with no flat polishing surface makes it difficult to planarize the surface of the substrate in its polishing process and would result in lowered yield of products.

In order to prevent the decrease in the yield of the products, it is necessary to know the profile of the polishing pad. However, obtaining the profile of the polishing pad entails the aforementioned procedures that take a lot of time and cost.

SUMMARY OF THE INVENTION

The present invention has been made in view of the above drawbacks. It is therefore an object of the present invention to provide a method and an apparatus capable of greatly reducing cost and time of the recipe tuning of the polishing pad conditioning and capable of monitoring the polishing surface of the polishing pad without removing the polishing pad from the polishing table.

One aspect of the present invention for achieving the above object is to provide a method of monitoring a polishing surface of a polishing pad for use in a polishing apparatus. The method includes: conditioning the polishing surface of the polishing pad by causing a rotating dresser to oscillate on the polishing surface; measuring a height of the polishing surface when said conditioning of the polishing surface is performed; calculating a position of a measuring point of the height on a two-dimensional surface defined on the polishing surface; and repeating the measuring of the height of the polishing surface and the calculating of the position of the measuring point to create height distribution in the polishing surface.

In a preferred aspect of the present invention, the method further includes: creating distribution of irregularity detected point of the height of the polishing surface from the height distribution; and evaluating the conditioning of the polishing pad based on the distribution of the irregularity detected point.

In a preferred aspect of the present invention, the evaluating of the conditioning of the polishing pad based on the distribution of the irregularity detected point comprises: calculating from the distribution of the irregularity detected point an irregularity occurrence density of the height of the polishing surface in plural regions defined in advance on the polishing surface; and determining that the conditioning of the polishing pad is not performed properly when the irregularity occurrence density in at least one of the plural regions has reached a predetermined threshold value.

In a preferred aspect of the present invention, the creating the distribution of the irregularity detected point of the height of the polishing surface from the height distribution comprises: arranging multiple measured values of the height of the polishing surface along a measurement temporal axis to create a measurement waveform that is composed of the multiple measured values; and plotting the irregularity detected point onto the two-dimensional surface in a position corresponding to a measured value which is obtained when an amplitude of the measurement waveform exceeds a predetermined value.

In a preferred aspect of the present invention, the creating the distribution of the irregularity detected point of the height of the polishing surface from the height distribution further comprises: creating a monitoring waveform by extracting from the measurement waveform an pulse component which is generated due to rotation of the dresser, wherein the plotting of the irregularity detected point comprises plotting the irregularity detected point onto the two-dimensional surface in a position corresponding to a measured value which is obtained when an amplitude of the monitoring waveform exceeds a predetermined value.

In a preferred aspect of the present invention, the creating of the monitoring waveform comprises creating a monitoring waveform by applying a band pass filter to the measurement waveform to extract from the measurement waveform an pulse component which is generated due to rotation of the dresser.

In a preferred aspect of the present invention, the creating of the monitoring waveform comprises creating a monitoring waveform by applying a band elimination filter to the measurement waveform to eliminate from the measurement waveform an pulse component which is generated due to oscillation of the dresser.

In a preferred aspect of the present invention, the creating the distribution of the irregularity detected point of the height of the polishing surface from the height distribution comprises: calculating a difference between two measured values that are obtained by repeating the measuring of the height of the polishing surface; and plotting the irregularity detected point onto the two-dimensional surface in a position corresponding to a measured value which is obtained when the difference exceeds a predetermined threshold value.

In a preferred aspect of the present invention, the creating the distribution of the irregularity detected point of the height of the polishing surface from the height distribution comprises: calculating an amount of change in measured value of the height of the polishing surface per predetermined time; and plotting the irregularity detected point onto the two-dimensional surface in a position corresponding to a measured value which is obtained when the amount of change exceeds a predetermined threshold value.

In a preferred aspect of the present invention, the method further includes creating a profile of the polishing pad from the height distribution.

Another aspect of the present invention is to provide an apparatus for monitoring a polishing surface of a polishing pad for use in a polishing apparatus. The apparatus includes: a rotatable dresser configured to condition the polishing surface of the polishing pad while oscillating on the polishing surface; a pad height sensor configured to measure a height of the polishing surface when conditioning of the polishing surface is performed; a position calculator configured to calculate a position of a measuring point of the height on a two-dimensional surface defined on the polishing surface; and a pad height analyzer configured to create height distribution in the polishing surface from measured value of the height of the polishing surface and the position of the measuring point.

According to the present invention, the height of the polishing surface of the polishing pad can be shown on the two-dimensional surface during conditioning of the polishing pad. Therefore, real-time monitoring of the polishing surface can be realized. It is not necessary to remove the polishing pad from the polishing table and therefore the time and cost of the recipe tuning of the pad conditioning can be reduced greatly. Moreover, it is possible to grasp the flatness of the polishing surface from the height of the polishing surface expressed on the two-dimensional surface. Therefore, the polishing pad can be replaced with a new polishing pad before the flatness of the polishing surface is lost. As a result, the decrease in the yield of the products can be prevented.

DETAILED DESCRIPTION OF THE PREFERRED EMBODIMENTS

Embodiments of the present invention will be described below with reference to the drawings.

Figure 1:
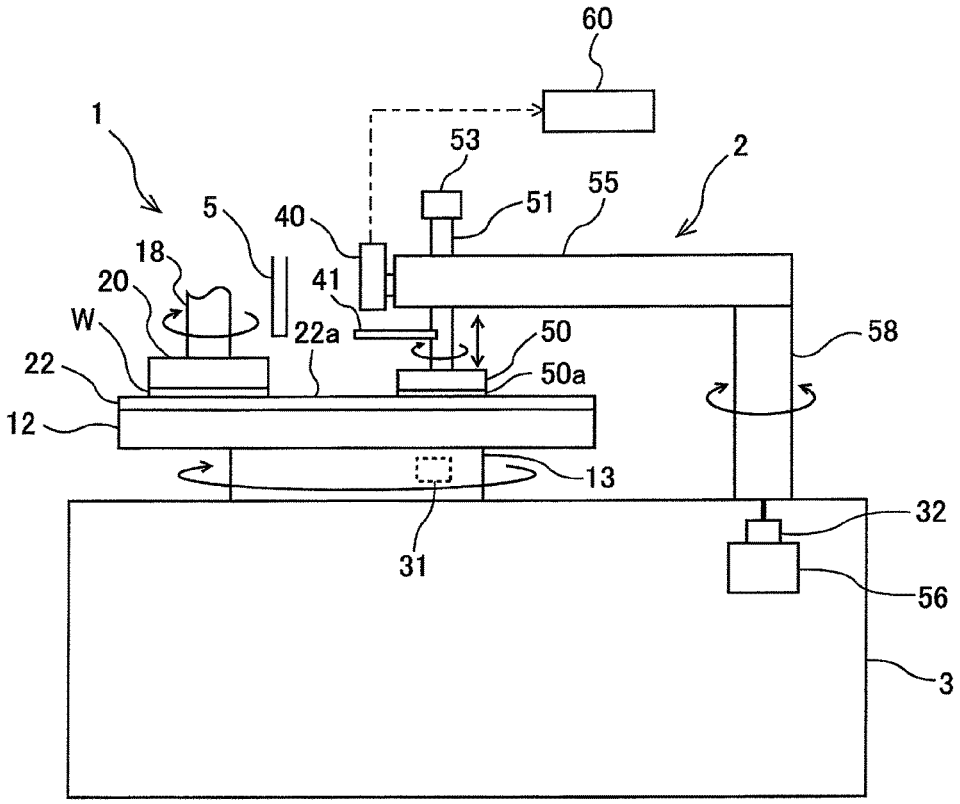
FIG. 1 is a schematic view of a polishing apparatus for polishing a substrate.

FIG. 1 is a schematic view of a polishing apparatus for polishing a substrate, such as a semiconductor wafer. As shown in FIG. 1, the polishing apparatus has: a polishing table 12 for holding a polishing pad 22 thereon; a polishing liquid supply nozzle 5 for supplying a polishing liquid onto the polishing pad 22; a polishing unit 1 for polishing a substrate W; and a dressing unit 2 for conditioning (or dressing) the polishing pad 22 used in polishing of the substrate W. The polishing unit 1 and the dressing unit 2 are provided on a base 3.

The polishing unit 1 has a top ring 20 coupled to a lower end of a top ring shaft 18. The top ring 20 is configured to hold the substrate W on its lower surface by vacuum suction. The top ring shaft 18 is rotated by a motor (not shown) to thereby rotate the top ring 20 and the substrate W. The top ring shaft 18 is configured to be moved in a vertical direction relative to the polishing pad 22 by an elevating mechanism (not shown) which is constructed by, for example, a servomotor, a ball screw, and other elements.

The polishing table 12 is coupled to a motor 13 disposed below the polishing table 12. This polishing table 12 is rotated about its own axis by the motor 13. The polishing pad 22 is attached to an upper surface of the polishing table 12. An upper surface of the polishing pad 22 serves as a polishing surface 22*a* for polishing the substrate W.

Polishing of the substrate W is performed as follows. The top ring 20 and the polishing table 12 are rotated, while the polishing liquid is supplied onto the polishing pad 22. In this state, the top ring 20, which is holding the substrate W, is lowered to press the substrate W against the polishing surface 22*a* of the polishing pad 22. The substrate W and the polishing pad 22 are brought into sliding contact with each other in the presence of the polishing liquid, whereby a surface of the substrate W is polished and planarized.

The dressing unit 2 has: a dresser 50 which is brought into contact with the polishing surface 22*a* of the polishing pad 22; a dresser shaft 51 coupled to the dresser 50; a pneumatic cylinder 53 provided on an upper end of the dresser shaft 51; and a dresser arm 55 rotatably supporting the dresser shaft 51. The dresser 50 has a dressing disk 50*a* that constructs a lower portion thereof. This dressing disk 50*a* has a lower surface to which diamond particles are fixed.

The dresser shaft 51 and the dresser 50 are movable in the vertical direction relative to the dresser arm 55. The pneumatic cylinder 53 is an actuator for enabling the dresser 50 to exert a dressing load on the polishing pad 22. The dressing load can be regulated by gas pressure (typically air pressure) supplied to the pneumatic cylinder 53.

The dresser arm 55 is driven by a motor 56 so as to swing on a support shaft 58. The dresser shaft 51 is rotated by a motor (not shown) provided in the dresser arm 55. This rotation of the dresser shaft 51 imparts to the dresser 50 rotation about its own axis. The pneumatic cylinder 53 presses the dresser 50 through the dresser shaft 51 against the polishing surface 22*a* of the polishing pad 22 with a predetermined load.

Conditioning of the polishing surface 22*a* of the polishing pad 22 is performed as follows. The polishing table 12 and the polishing pad 22 are rotated by the motor 13. In this state, a dressing liquid (e.g., pure water) is supplied onto the polishing surface 22*a* of the polishing pad 22 from a dressing liquid supply nozzle (not shown). Further, the dresser 50 is rotated about its own axis. The dresser 50 is pressed against the polishing surface 22*a* by the pneumatic cylinder 53 to bring the lower surface of the dressing disk 50*a* into sliding contact with the polishing surface 22*a*. In this state, the dresser arm 55 swings to cause the dresser 50 to move (i.e., oscillate) on the polishing pad 22 in substantially radial direction of the polishing pad 22. The rotating dresser 50 scrapes the polishing pad 22 to thereby condition (or dress) the polishing surface 22*a*.

A pad height sensor 40 for measuring a height of the polishing surface 22*a* is secured to the dresser arm 55. Further, a sensor target 41 is secured to the dresser shaft 51 so as to face the pad height sensor 40. The sensor target 41 moves together with the dresser shaft 51 and the dresser 50 in the vertical direction, while the pad height sensor 40 is fixed in its vertical position. The pad height sensor 40 is a displacement sensor capable of measuring a displacement of the sensor target 41 to indirectly measure the height of the polishing surface 22*a* (i.e., a thickness of the polishing pad 22). Since the sensor target 41 is coupled to the dresser 50, the pad height sensor 40 can measure the height of the polishing surface 22*a* during conditioning of the polishing pad 22.

The pad height sensor 40 measures the height of the polishing surface 22*a* indirectly from the vertical position of the dresser 50 when contacting the polishing surface 22*a*. That is, the pad height sensor 40 measures an average of the height of the polishing surface 22*a* in a region where the lower surface (i.e., the dressing surface) of the dresser 50 contacts. Any type of sensor, such as linear scale sensor, laser sensor, ultrasonic sensor, or eddy current sensor, can be used as the pad height sensor 40.

The pad height sensor 40 is coupled to a pad monitoring apparatus 60, so that output signal of the pad height sensor 40 (i.e., measured value of the height of the polishing surface 22*a*) is sent to the pad monitoring apparatus 60. This pad monitoring apparatus 60 has functions to obtain a profile of the polishing pad 22 (i.e., a cross-sectional shape of the polishing surface 22*a*) from the measured values of the height of the polishing surface 22*a* and to judge whether or not conditioning of the polishing pad 22 is performed properly.

The polishing apparatus further has: a table rotary encoder 31 for measuring a rotation angle of the polishing table 12 and the polishing pad 22; and a dresser rotary encoder 32 for measuring an oscillation angle of the dresser 50. The table rotary encoder 31 and the dresser rotary encoder 32 are an absolute encoder designed to measure an absolute value of the angle.

Figure 2:
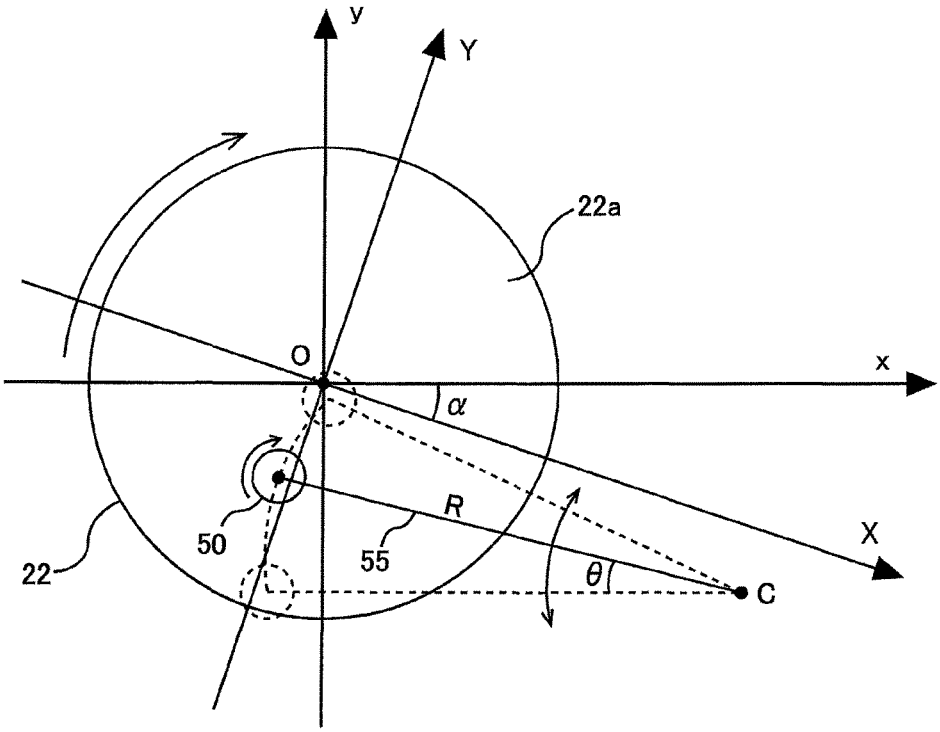
FIG. 2 is a schematic plan view of a polishing pad and a dresser.

FIG. 2 is a schematic plan view of the polishing pad 22 and the dresser 50. In FIG. 2, x-y coordinate system is a stationary coordinate system defined on the base 3 (see FIG. 1), and X-Y coordinate system is a rotating coordinate system defined on the polishing surface 22*a* of the polishing pad 22. As show in FIG. 2, the polishing table 12 and the polishing pad 22 thereon rotate about an origin O of the x-y stationary coordinate system, while the dresser 50 rotates through a predetermined angle about a predetermined point C on the x-y stationary coordinate system (i.e., the dresser 50 oscillates). The position of the point C corresponds to a central position of the support shaft 58 shown in FIG. 1.

Since relative position of the polishing table 12 and the support shaft 58 is fixed, coordinates of the point C on the x-y stationary coordinate system are necessarily determined. An oscillation angle $\theta$ of the dresser 50 with respect to the point C is a swing angle of the dresser arm 55. This oscillation angle $\theta$ is measured by the dresser rotary encoder 32. The rotation angle $\alpha$ of the polishing pad 22 (i.e., the polishing table 12) is an angle between a coordinate axis of the x-y stationary coordinate system and a coordinate axis of the X-Y rotating coordinate system. This rotation angle $\alpha$ is measured by the table rotary encoder 31.

A distance R between the dresser 50 and the central point C of its oscillation (i.e., swing motion) is a known value that is determined from design of the polishing apparatus. Coordinates of the center of the dresser 50 on the x-y stationary coordinate system can be determined from the coordinates of the point C, the distance R, and the angle θ. Further, coordinates of the center of the dresser 50 on the X-Y rotating coordinate system can be determined from the coordinates of the center of the dresser 50 on the x-y stationary coordinate system and the rotation angle α of the polishing pad 22. Conversion of the coordinates on the stationary coordinate system into the coordinates on the rotating coordinate system can be carried out using known trigonometric functions and four arithmetic operations.

The table rotary encoder 31 and the dresser rotary encoder 32 are coupled to the pad monitoring apparatus 60, so that the measured value of the rotation angle α and the measured value of the oscillation angle θ are sent to the pad monitoring apparatus 60.

The aforementioned distance R between the dresser 50 and the point C and the relative position of the support shaft 58 with respect to the polishing table 12 are stored in advance in the pad monitoring apparatus 60.

The pad monitoring apparatus 60 calculates the coordinates of the center of the dresser 50 on the X-Y rotating coordinate system from the rotation angle α and the oscillation angle θ as described above. The X-Y rotating coordinate system is a two-dimensional surface defined on the polishing surface 22*a*. That is, the coordinates of the dresser 50 on the X-Y rotating coordinate system indicate the relative position of the dresser 50 with respect to the polishing surface 22*a*. In this manner, the position of the dresser 50 is expressed as the position on the two-dimensional surface defined on the polishing surface 22*a*.

The pad height sensor 40 is configured to measure the height of the polishing surface 22*a* at predetermined time intervals during conditioning of the polishing pad 22 by the dresser 50. Each time the pad height sensor 40 measures the height of the polishing surface 22*a*, the measured value is sent to the pad monitoring apparatus 60. In this pad monitoring apparatus 60, each measured value is associated with coordinates of a measuring point on the X-Y rotating coordinate system (i.e., the position of the center of the dresser 50). These coordinates indicate the position of the measuring point on the polishing pad 22. Each measured value and the position of the measuring point associated with the measured value are stored in the pad monitoring apparatus 60.

Figure 3A:
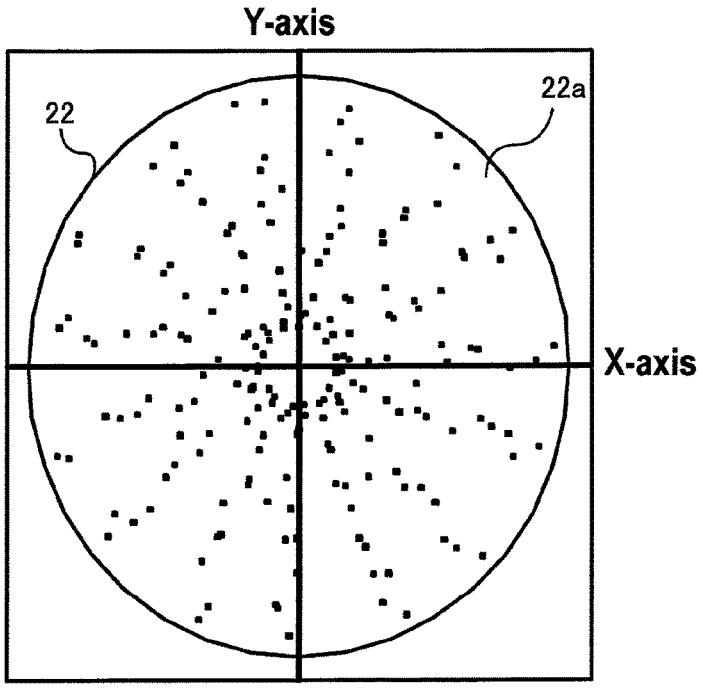
FIG. 3A is a diagram showing height distribution obtained by measuring height of a polishing surface for 20 seconds.
Figure 3B:
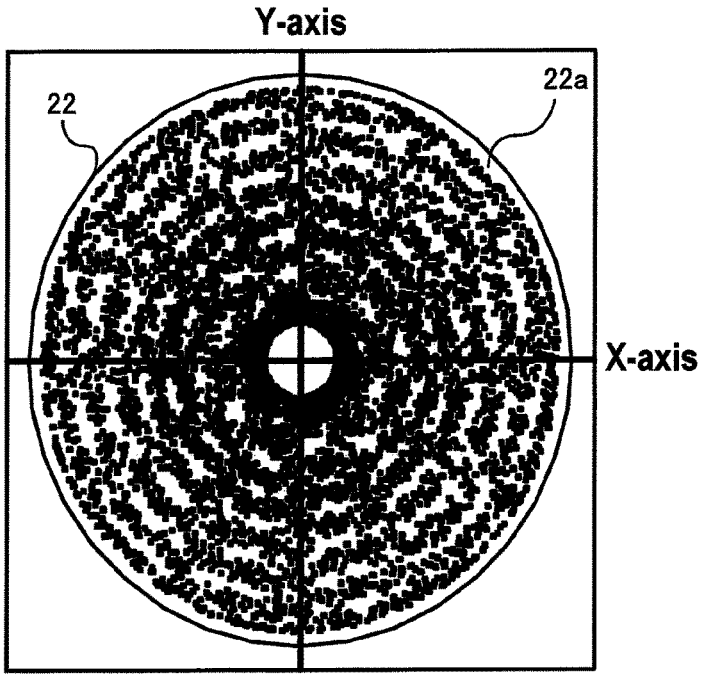
FIG. 3B is a diagram showing height distribution obtained by measuring the height of the polishing surface for 600 seconds.

Further, the pad monitoring apparatus 60 plots the measuring points onto the X-Y rotating coordinate system defined on the polishing pad 22 to create a height distribution as shown in FIG. 3A and FIG. 3B. FIG. 3A shows a height distribution obtained by measuring the height of the polishing surface 22*a* for 20 seconds, and FIG. 3B shows a height distribution obtained by measuring the height of the polishing surface 22*a* for 600 seconds. The height distribution is a distribution of the height of the polishing surface 22*a*. Each of the measuring points that appear in the height distributions shown in FIG. 3A and FIG. 3B includes information about the height of the polishing surface 22*a* and the position of the corresponding measuring point. Therefore, the profile of the polishing pad 22 can be obtained from the height distribution.

If conditioning of the polishing pad 22 is not performed properly, the polishing pad 22 would be scraped away locally by the dresser 50. As a result, the flatness of the polishing surface 22*a* would be lost. To prevent this, the pad monitoring apparatus 60 monitors whether the polishing surface 22*a* is flat or not based on the output signal of the pad height sensor 40, i.e., whether conditioning of the polishing pad 22 is performed properly or not.

Figure 4A:
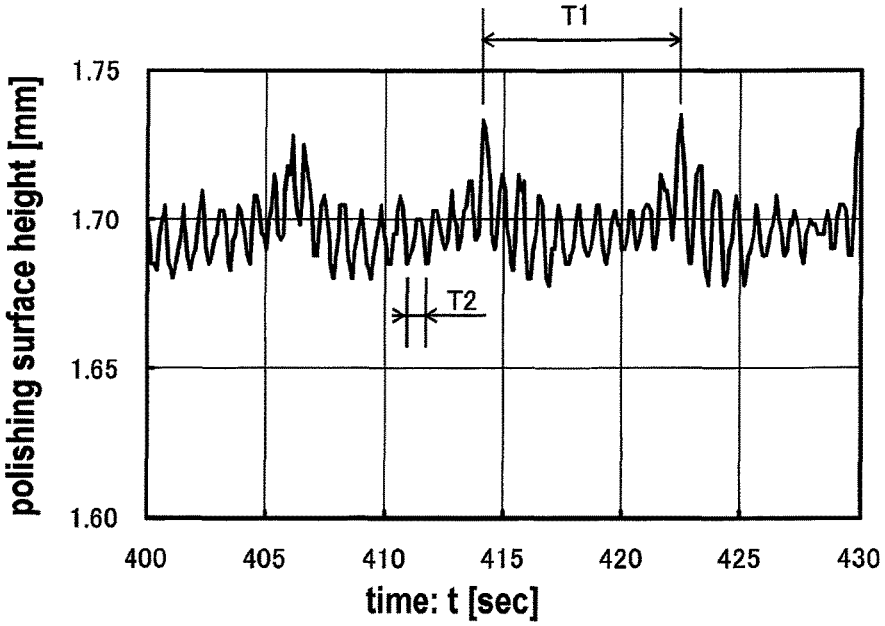
FIG. 4A is a graph showing output signal of a pad height sensor when conditioning an even polishing surface.
Figure 4B:
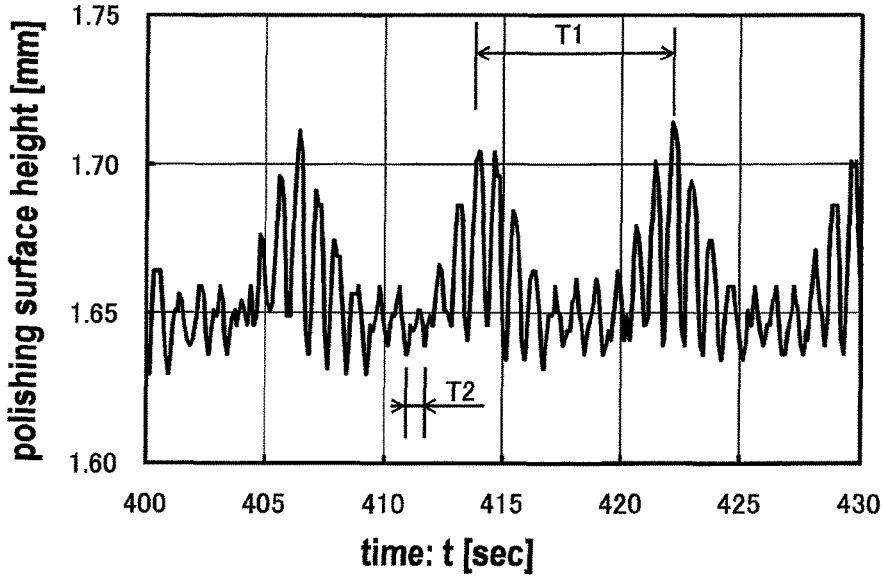
FIG. 4B is a graph showing the output signal of the pad height sensor when conditioning an uneven polishing surface.

The pad monitoring apparatus 60 is configured to arrange the measured values, which are sent from the pad height sensor 40, along a measurement temporal axis to create a graph indicating a temporal change in the height of the polishing surface 22*a*. FIG. 4A is a graph showing the output signal of the pad height sensor 40 when conditioning an even polishing surface 22*a*, and FIG. 4B is a graph showing the output signal of the pad height sensor 40 when conditioning an uneven polishing surface 22*a*. In FIG. 4A and FIG. 4B, a vertical axis represents the height of the polishing surface 22*a* and a horizontal axis represents measuring time of the height of the polishing surface 22*a*.

The measured values that have been arranged along the measurement temporal axis form a waveform as shown in FIG. 4A and FIG. 4B. This waveform is a measurement waveform constructed by multiple measured values. As can be seen from FIG. 4A and FIG. 4B, the waveform contains two pulse components with different periods T1 and T2. The pulse component having the long period T1 is generated due to parallelism between the polishing surface 22*a* and a swing plane of the dresser arm 55. The period T1 corresponds to an oscillation period of the dresser 50. It can be seen from the graph that the output signal of the pad height sensor 40 becomes large when the dresser 50 is located on a peripheral portion of the polishing pad 22. This indicates the fact that the dresser 50 is more likely to be caught by (i.e., stumble over) the polishing pad 22 when it is on the peripheral portion than on the central portion of the polishing pad 22.

The short period T2 corresponds to the rotation period of the dresser 50. The pulse component having the period T2 is generated due to the fact that the rotational speed of the polishing table 12 and the rotational speed of the dresser 50 are not the same but are relatively close to each other. In the graph shown in FIG. 4A, the pulse component having the short period T2 has substantially the same amplitude as an amplitude of the pulse component having the long period T1. In contrast, in the graph shown in FIG. 4B, the pulse component having the short period T2 has an amplitude larger than an amplitude of the pulse component having the long period T1. It can be seen from these graphs that, as the flatness of the polishing surface 22*a* of the polishing pad 22 is lost, the amplitude of the pulse component having the short period T2 becomes larger.

Thus, the pad monitoring apparatus 60 determines whether the polishing surface 22*a* of the polishing pad 22 that is being conditioned is flat or not based on the measured values of the height of the polishing surface 22*a* obtained from the pad height sensor 40. The pad monitoring apparatus 60 has a judging device 70 for judging whether or not the polishing surface 22*a* of the polishing pad 22 is flat based on the amplitude of the measurement waveform that indicates the temporal change in the measured value of the height of the polishing surface 22*a*. This judging device 70 is configured to judge that the polishing surface 22*a* is not flat when the amplitude of the measurement waveform exceeds a predetermined threshold value.

Figure 5:
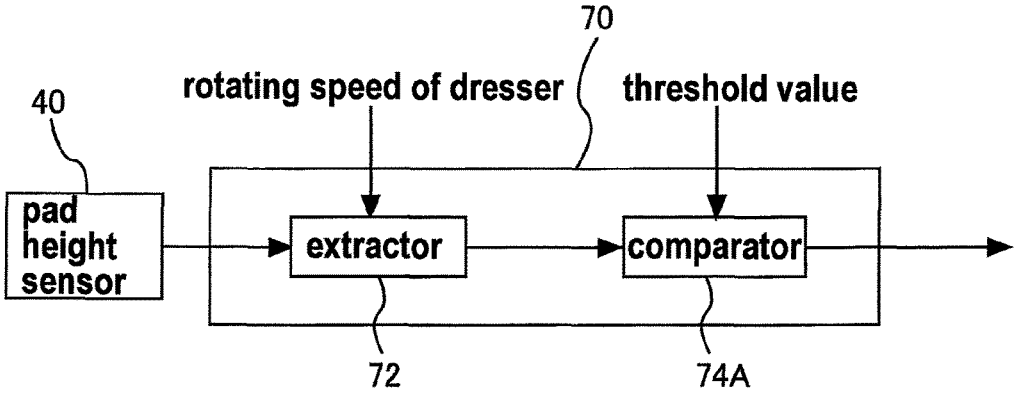
FIG. 5 is a block diagram showing an example of a judging device.

FIG. 5 is a block diagram showing an example of the judging device 70. The judging device 70 has an extractor 72 configured to extract the pulse component having the period T2 from the measurement waveform. This extractor 72 is configured to arrange multiple measured values, which are sent from the pad height sensor 40, along the measurement temporal axis to create the measurement waveform and to extract the pulse component having the period T2 from the measurement waveform to thereby create a monitoring waveform. A band-pass filter can be used for extracting the pulse component having the period T2. A pass band of the band-pass filter is the reciprocal of the period T2. Since the period T2 corresponds to the rotation period of the dresser 50 as described above, the pass band of the band-pass filter is given by the rotational speed of the dresser 50. The judging device 70 further has a comparator 74A configured to determine whether or not amplitude of the monitoring waveform is larger than the predetermined threshold value.

Figure 6:
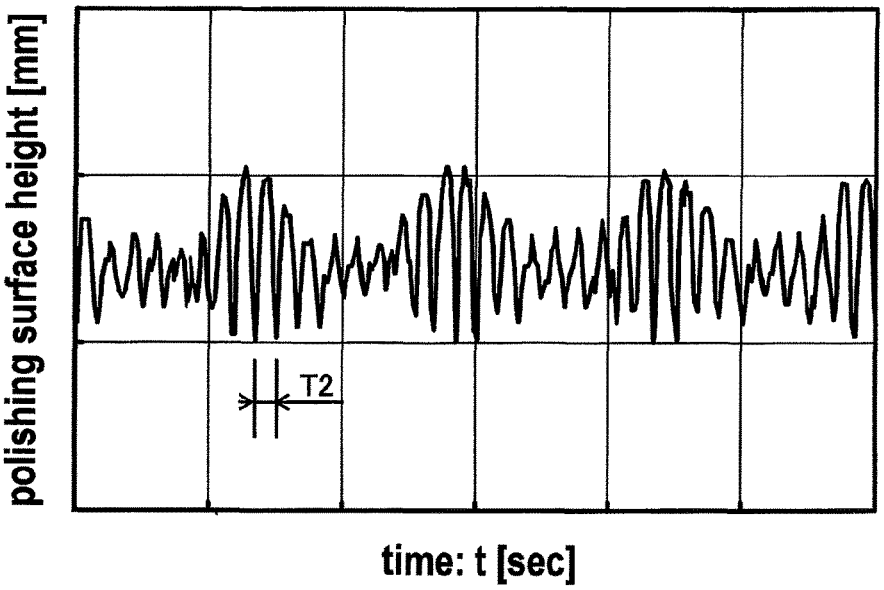
FIG. 6 is a graph showing a monitoring waveform outputted from an extractor.

FIG. 6 is a graph showing the monitoring waveform outputted from the extractor 72. As can be seen from FIG. 6, only the pulse component having the period T2 appears on the monitoring waveform. Therefore, the comparator 74A can compare the amplitude of the pulse component having the period T2 with the predetermined threshold value. If the measurement waveform does not have the pulse component having the period T1 therein, the extractor 72 may be omitted.

Figure 7:
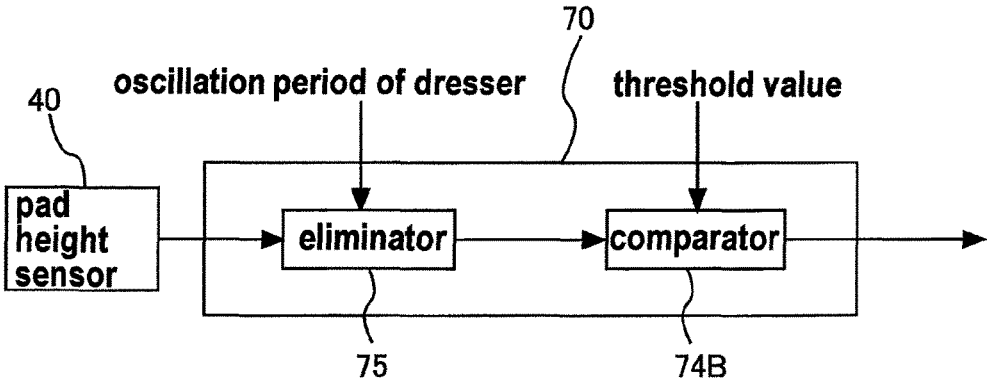
FIG. 7 is a block diagram showing another example of the judging device.

FIG. 7 is a block diagram showing another example of the judging device 70. The judging device 70 has an eliminator 75 configured to eliminate the pulse component having the period T1 from the measurement waveform. This eliminator 75 is configured to arrange multiple measured values, which are sent from the pad height sensor 40, along the measurement temporal axis to create the measurement waveform and to eliminate the pulse component having the period T1 from the measurement waveform to thereby create a monitoring waveform. A band-elimination filter can be used for eliminating the pulse component having the period T1. A stopband of the band-elimination filter is the reciprocal of the period T1. Since the period T1 corresponds to the oscillation period of the dresser 50 as described above, the stopband of the band-elimination filter is given by the oscillation period of the dresser 50.

The judging device 70 further has a comparator 74B configured to determine whether or not the amplitude of the monitoring waveform is larger than the predetermined threshold value. The monitoring waveform outputted from the eliminator 75 is substantially the same as the waveform shown in FIG. 6. Therefore, the comparator 74B can compare the amplitude of the pulse component having the period T2 with the predetermined threshold value. If the measurement waveform does not have the pulse component having the period Ti therein, the eliminator 75 may be omitted.

Figure 8:
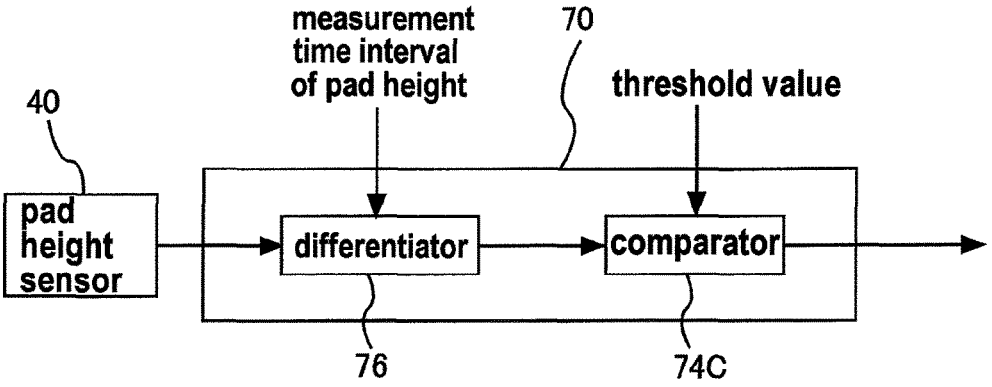
FIG. 8 is a block diagram showing still another example of the judging device.

FIG. 8 is a block diagram showing still another example of the judging device 70. The judging device 70 has: a differentiator 76 configured to calculate an amount (absolute value) of change in the measured value of the height of the polishing surface 22*a* per predetermined time; and a comparator 74C configured to determine whether or not the amount of the change obtained is larger than a predetermined threshold value. The predetermined time used in the differentiator 76 may be a measurement time interval of the pad height sensor 40. The differentiator 76 calculates the amount of change in the measured value per predetermined time each time it receives the measured value from the pad height sensor 40.

Figure 9:
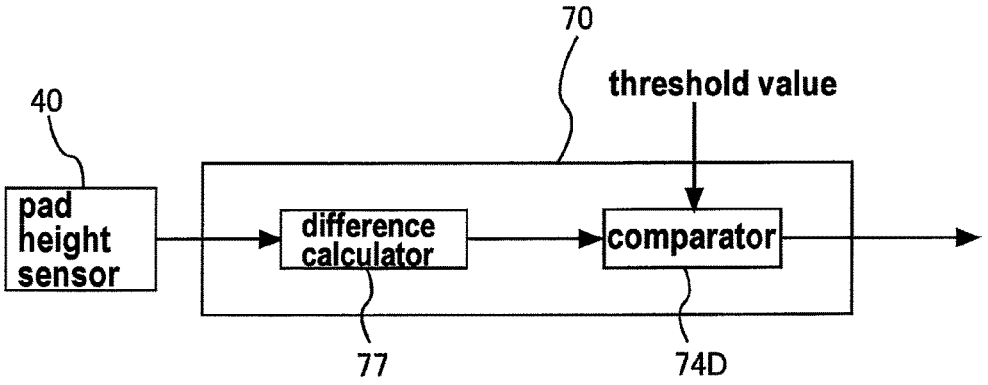
FIG. 9 is a block diagram showing still another example of the judging device.

FIG. 9 is a block diagram showing still another example of the judging device 70. The judging device 70 has: a difference calculator 77 configured to calculate difference (absolute value) between two measured values of the height of the polishing surface 22*a;* and a comparator 74D configured to determine whether or not the difference obtained is larger than a predetermined threshold value. The difference calculator 77 calculates the difference between the latest two measured values each time it receives the measured value from the pad height sensor 40.

Figure 10:
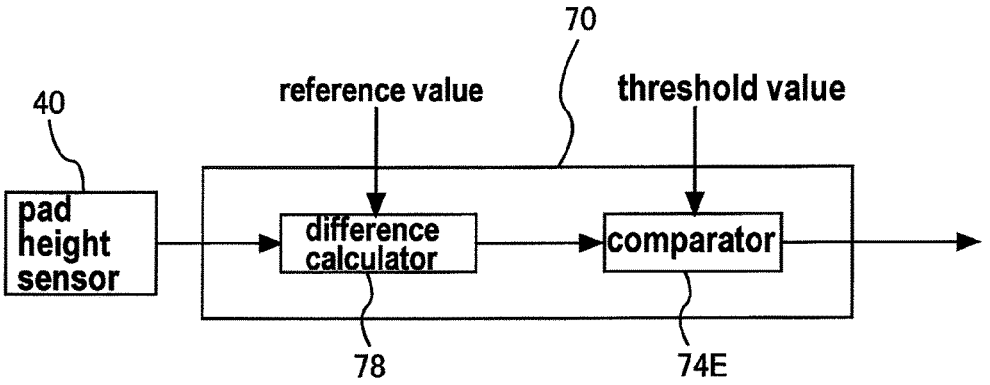
FIG. 10 is a block diagram showing still another example of the judging device.

FIG. 10 is a block diagram showing still another example of the judging device 70. The judging device 70 has: a difference calculator 78 configured to calculate difference (absolute value) between a predetermined reference value and the measured value of the height of the polishing surface 22*a;* and a comparator 74E configured to determine whether or not the difference obtained is larger than a predetermined threshold value. The predetermined reference value used in the difference calculator 78 may be a measured value of an initial height of the polishing surface 22*a*. The difference calculator 78 calculates the aforementioned difference each time it receives the measured value from the pad height sensor 40.

Figure 11:
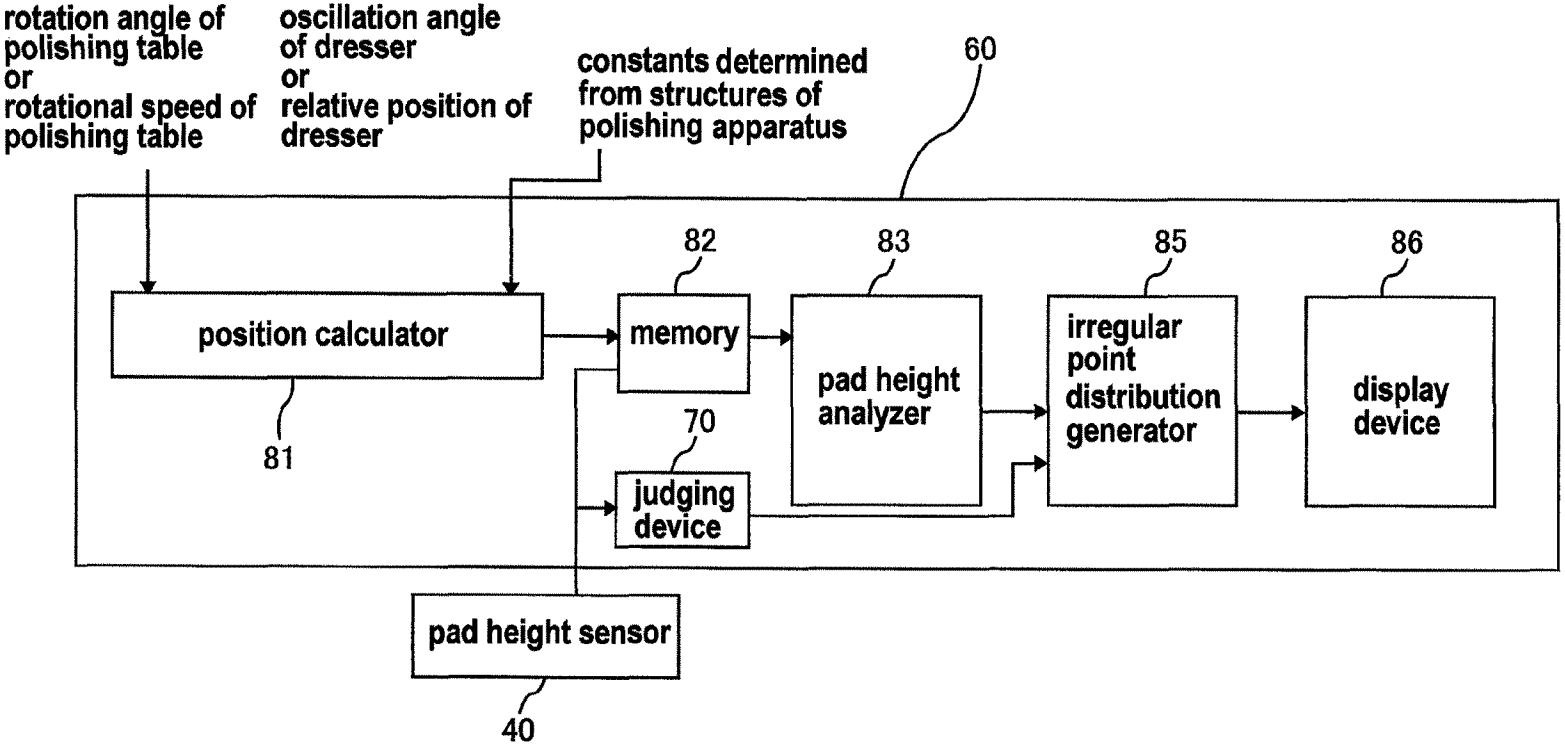
FIG. 11 is a schematic view of an example of a pad monitoring apparatus.

FIG. 11 is a schematic view of an example of the pad monitoring apparatus 60. As shown in FIG. 11, the pad monitoring apparatus 60 has: a position calculator 81 configured to calculate the position of the dresser 50 on the polishing pad 22; a measurement data memory 82 configured to store the position of the dresser 50 and the measured value of the height of the polishing surface 22*a* which are associated with each other; the judging device 70 illustrated in any one of FIGS. 5, 7, 8, 9, and 10; and a pad height analyzer 83 configured to create from the measured value and the position of the dresser 50 the height distribution (see FIG. 3A and FIG. 3B) indicating the distribution of the height of the polishing surface 22*a*.

As described above, the position calculator 81 calculates the position of the dresser 50 on the two-dimensional surface which is the X-Y rotating coordinate system defined on the polishing surface 22*a*. The position of the dresser 50 is a position of the measuring point at which the height of the polishing surface 22*a* is measured. This position of the measuring point is associated with the measured value at that measuring point. Further, a measurement time at which the measured value is obtained is associated with that measured value and the position of the corresponding measuring point. The measured value, the position of the measuring point, and the measurement time are stored as one set of measurement data in the measurement data memory 82.

Constants that are determined from structures of the polishing table 12 and the dressing unit 2 are stored in advance in the position calculator 81. These constants are numeric constants that are necessary for converting the coordinates on the x-y stationary coordinate system defined on the base 3 of the polishing apparatus into the coordinates on the X-Y rotating coordinate system defined on the polishing pad 22. More specifically, the constants include the distance R between the dresser 50 and the central point C of its swing motion and the relative position of the point C with respect to the central point O of the polishing table 12 as shown in FIG. 2.

The pad monitoring apparatus 60 further has an irregular point distribution generator 85 configured to generate distribution of irregularity detected point that indicates a position at which the polishing surface 22*a* is not flat. If the judging device 70 judges that the polishing surface 22*a* is not flat, the irregular point distribution generator 85 plots an irregularity detected point onto the two-dimensional surface (i.e., the X-Y rotating coordinate system) defined on the polishing surface 22*a*. The position at which the irregularity detected point is plotted is a position of the measuring point at which the polishing surface 22*a* is judged to be not flat. The distribution of the irregularity detected point is displayed on a display device 86.

Figure 12:
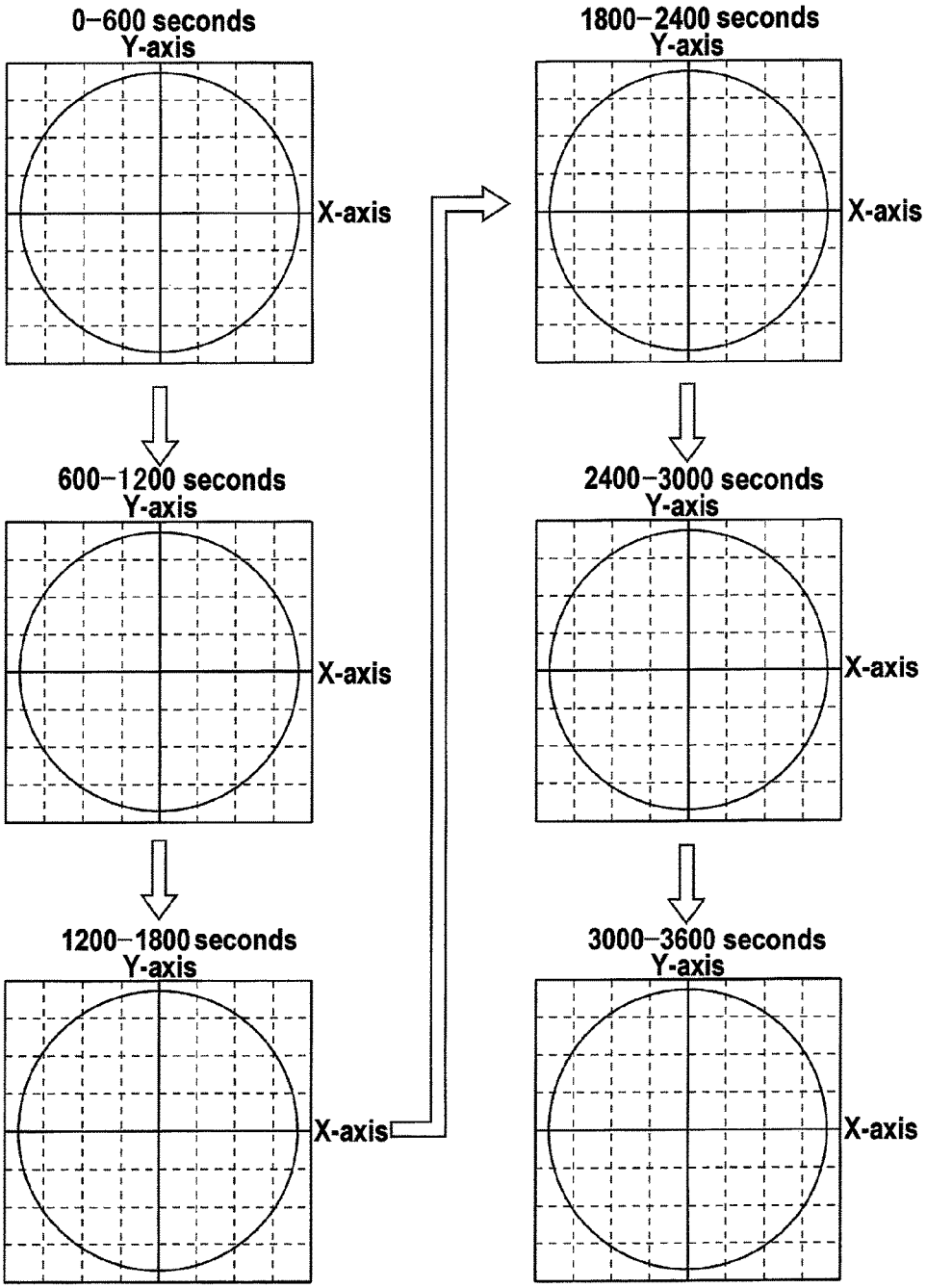
FIG. 12 is diagrams each showing distribution of irregularity detected points obtained when conditioning of the polishing surface is being performed properly.
Figure 13:
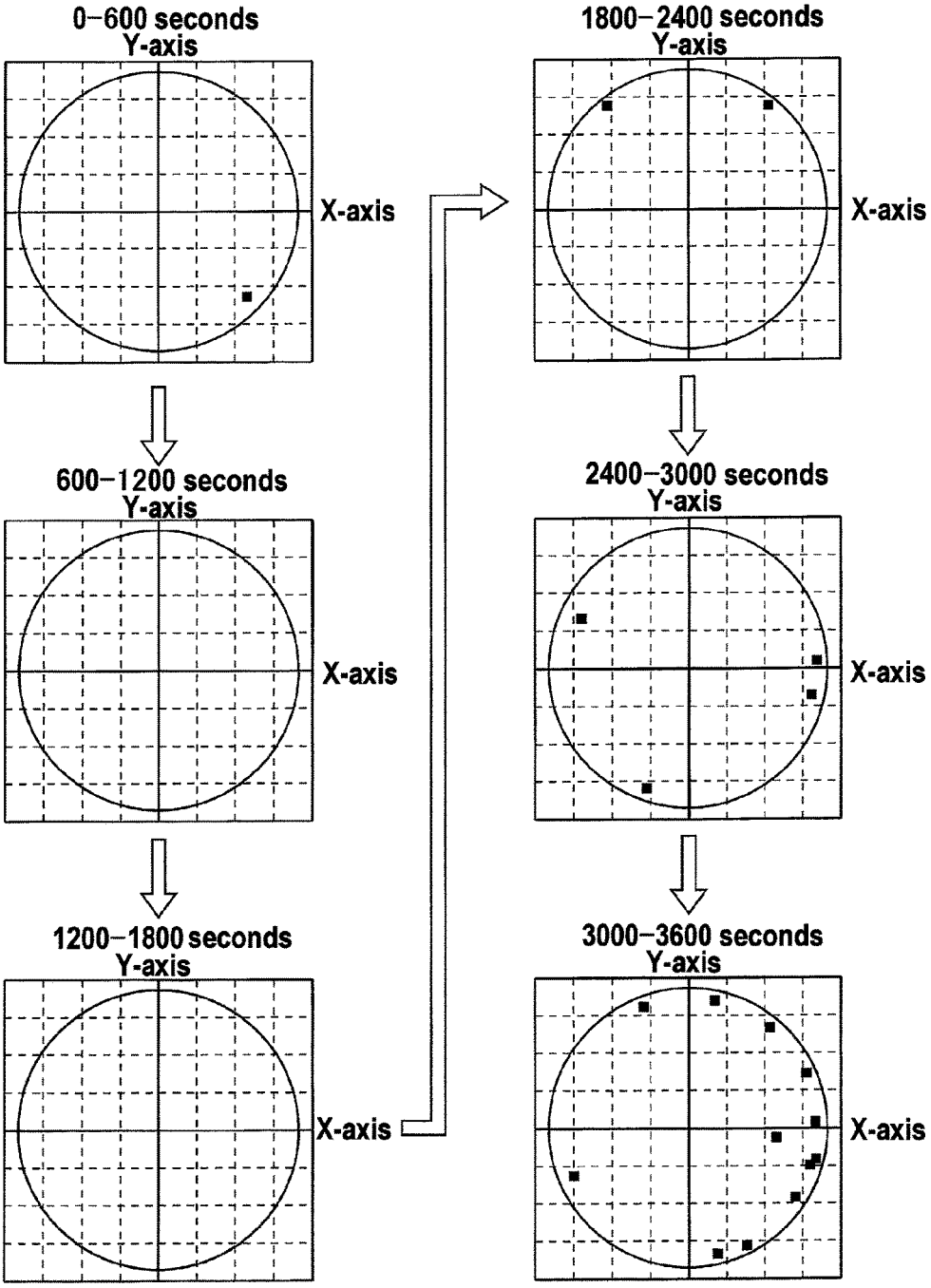
FIG. 13 is diagrams each showing distribution of the irregularity detected points obtained when conditioning of the polishing surface is not performed properly.

FIG. 12 is diagrams each showing the distribution of the irregularity detected points obtained when conditioning of the polishing surface 22*a* is being performed properly. More specifically, FIG. 12 shows the distributions of the irregularity detected points that are obtained every 600 seconds. As shown in FIG. 12, when the polishing surface 22*a* is being conditioned properly, the polishing surface 22*a* is kept flat. Therefore, the irregularity detected point does not appear on the X-Y rotating coordinate system. In contrast, FIG. 13 shows diagrams each showing the distribution of the irregularity detected points obtained when conditioning of the polishing surface 22*a* is not performed properly. As shown in FIG. 13, when conditioning of the polishing surface 22*a* is not performed properly, the flatness of the polishing surface 22*a* is lost gradually with time. As a result, the irregularity detected point appears on the X-Y rotating coordinate system. Accordingly, it is possible to determine whether conditioning of the polishing surface 22*a* is performed properly or not from the irregularity detected point that appears on the two-dimensional surface defined on the polishing surface 22*a*.

The irregular point distribution generator 85 further has a function to calculate density of the irregularity detected point that appears on the two-dimensional surface. Specifically, the irregular point distribution generator 85 calculates an irregularity occurrence density in each of plural regions on the two-dimensional surface and determines whether or not the irregularity occurrence density exceeds a predetermined threshold value in each region. The aforementioned regions on the two-dimensional surface are grid regions defined in advance on the X-Y rotating coordinate system on the polishing surface 22*a*.

Figure 14:
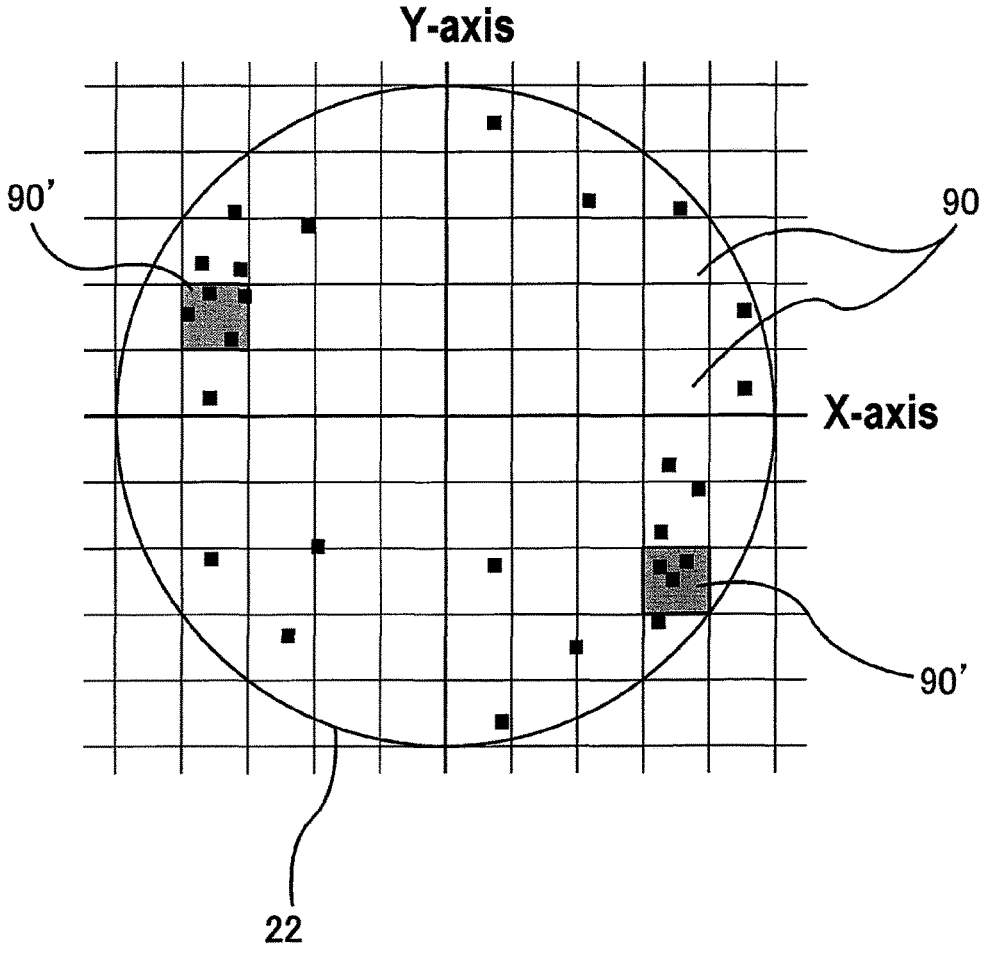
FIG. 14 is a diagram showing plural regions defined on X-Y rotating coordinate system.

FIG. 14 is a diagram showing the plural regions defined on the X-Y rotating coordinate system. The density of the irregularity detected points can be given by dividing the number of irregularity detected points in each region 90 by an area of the region 90. Regions indicated by reference numeral 90' shown in FIG. 14 are regions where the density of the irregularity detected points has reached the predetermined threshold value. As shown in FIG. 14, it is preferable to color the region where the density of the irregularity detected points has reached the predetermined threshold value. When the density of the irregularity detected points in at least one region 90 has reached the predetermined threshold value, the irregular point distribution generator 85 outputs a signal indicating that conditioning of the polishing surface 22*a* is not performed properly.

In this manner, irregular height regions in the polishing surface 22*a* can be indicated on the two-dimensional surface. Therefore, the polishing pad can be replaced with a new polishing pad before the flatness of the polishing surface 22*a* is lost. This can prevent the decrease in the yield of the products. Further, it is possible to know whether or not conditioning of the polishing pad 22 is being performed properly during conditioning of the polishing pad 22. In order to make it easier to visually recognize the occurrence of the irregularity detected points, it is preferable to express the density of the irregularity detected points with shade or intensity of color. Further, it is preferable to calculate an average of the height of the polishing surface 22*a* in each region and display the average of the height in the display device 86 if necessary.

Figure 15:
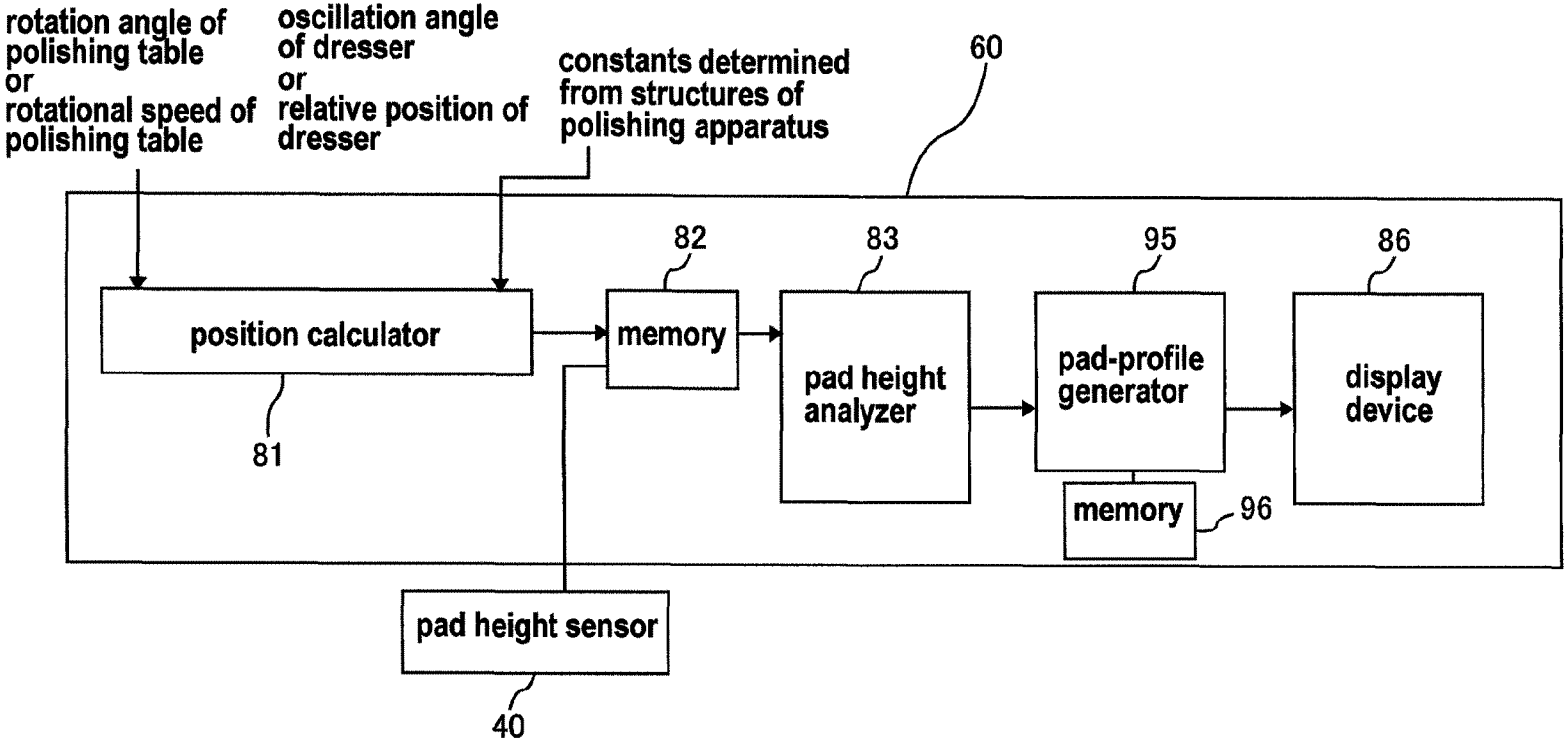
FIG. 15 is a schematic view of another example of the pad monitoring apparatus.

FIG. 15 is a schematic view of another example of the pad monitoring apparatus 60. As shown in FIG. 15, the pad monitoring apparatus 60 has: the above-described position calculator 81; the measurement data memory 82; the pad height analyzer 83; and a pad-profile generator 95 configured to obtain a profile of the polishing pad 22 from the height distribution obtained in the pad height analyzer 83. In this example, the above-described judging device 70 and the irregular point distribution generator 85 are not provided. However, these judging device 70 and irregular point distribution generator 85 may be provided in the pad monitoring apparatus 60 shown in FIG. 15.

Figure 16:
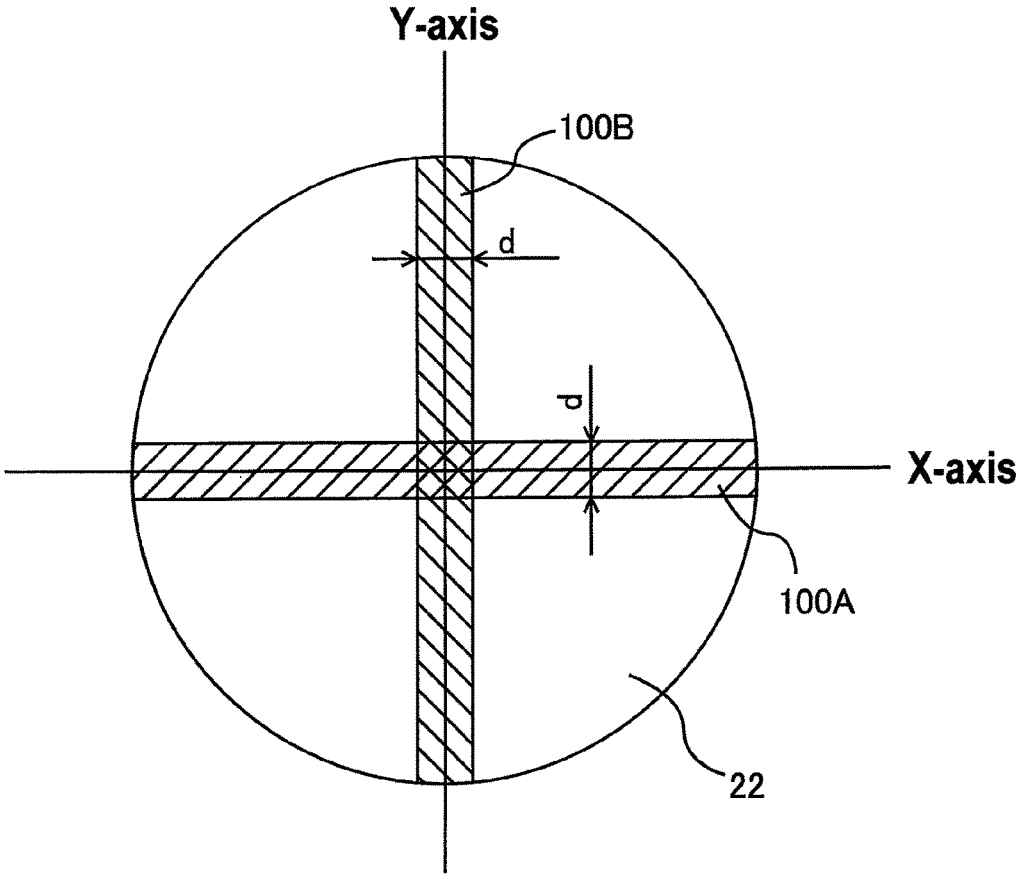
FIG. 16 is a diagram showing sampling areas on the X-Y rotating coordinate system defined on the polishing pad.

The pad-profile generator 95 is configured to arrange the measured values at measuring points in predetermined sampling regions, which extend on the X axis and the Y axis of the X-Y rotating coordinate system, along the X axis and the Y axis to thereby create a X-axis profile and a Y-axis profile of the polishing pad 22. FIG. 16 is a diagram showing the sampling regions on the X-Y rotating coordinate system defined on the polishing pad 22. In FIG. 16, reference numeral 100A represents the sampling region extending on the X axis, and reference numeral 100B represents the sampling region extending on the Y axis. These sampling regions 100A and 100B have a certain width d, which is preferably approximately the same as a diameter of the dresser 50. This is to obtain enough measured values for creating the profiles of the polishing pad 22.

Figure 17:
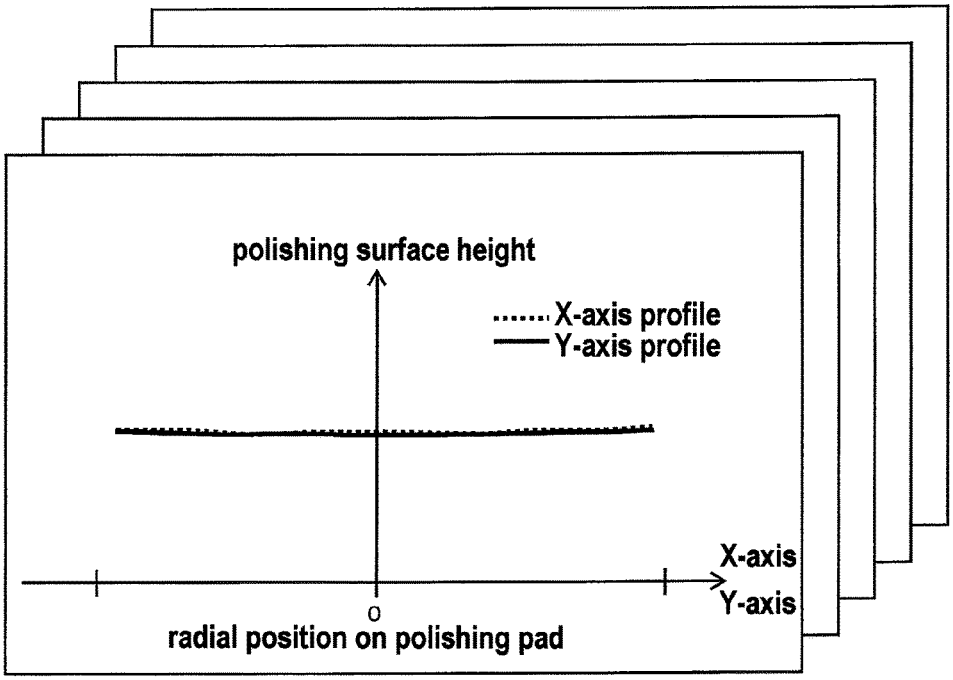
FIG. 17 is a diagram showing a X-axis profile and a Y-axis profile of the polishing pad displayed on a display device.

The pad profile generator 95 is configured to extract the measured values existing in the sampling regions 100A and 100B and to create the X-axis profile and the Y-axis profile of the polishing pad 22. The X-axis profile and the Y-axis profile created are displayed on the display device 86. FIG. 17 is a diagram showing the X-axis profile and the Y-axis profile. The X-axis profile represents the height of the polishing surface 22*a* along the X axis, i.e., the cross-sectional shape of the polishing surface 22*a* along the X axis. The Y-axis profile represents the height of the polishing surface 22*a* along the Y axis, i.e., the cross-sectional shape of the polishing surface 22*a* along the Y axis. These profiles can be displayed on the display device 86 during conditioning of the polishing pad 22. The profiles obtained are stored in a pad profile memory 96 shown in FIG. 15.

Figure 18:
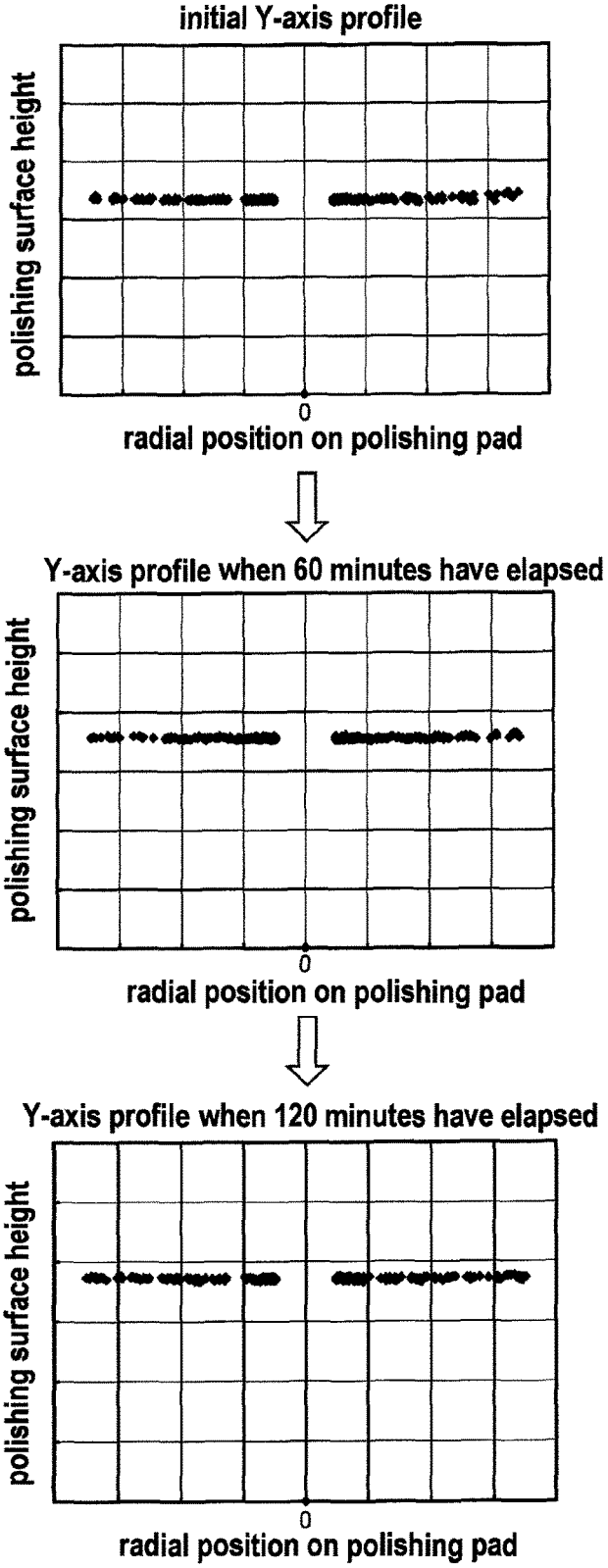
FIG. 18 is diagrams each showing a change in the Y-axis profile with time when conditioning of the polishing pad is performed properly.
Figure 19:
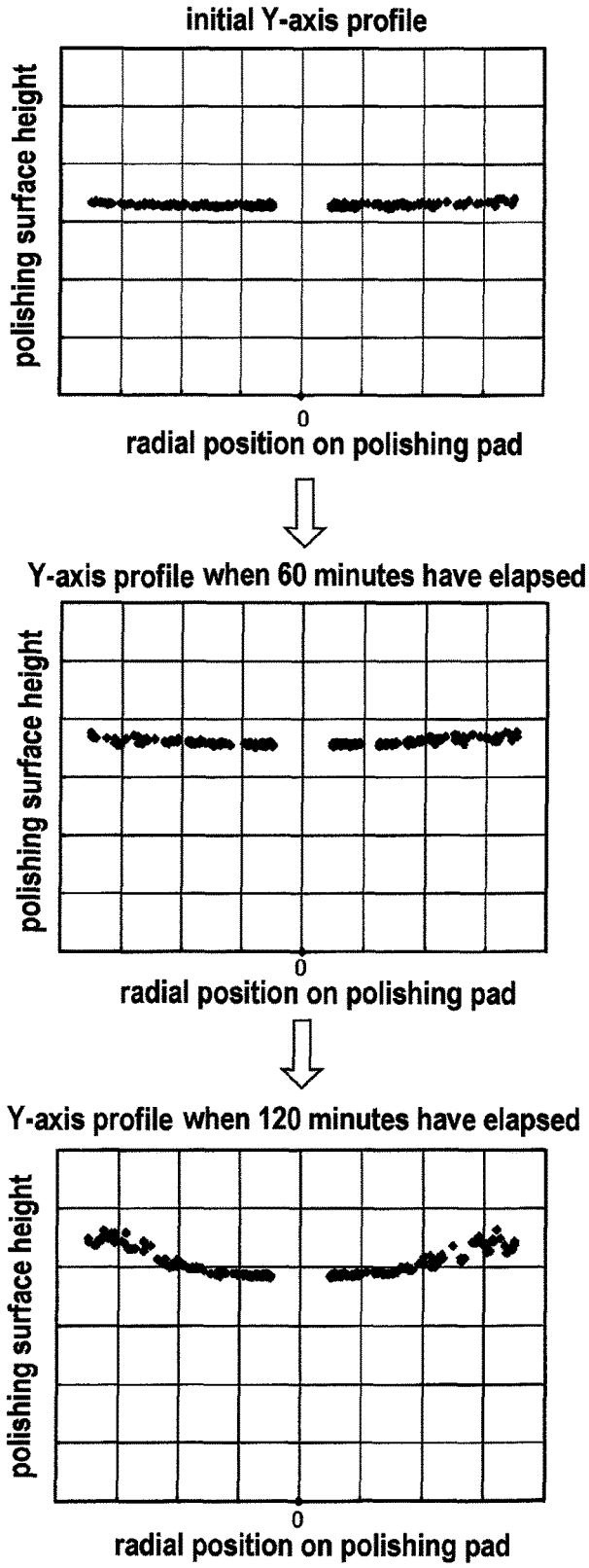
FIG. 19 is diagrams each showing a change in the Y-axis profile with time when conditioning of the polishing pad is not performed properly.

FIG. 18 shows diagrams showing a temporal change in the Y-axis profile when conditioning of the polishing pad 22 is performed properly. As can be seen from FIG. 18, when conditioning of the polishing pad 22 is performed properly, the polishing surface 22*a* is kept flat over time. FIG. 19 shows diagrams showing a temporal change in the Y-axis profile when conditioning of the polishing pad 22 is not performed properly. As can be seen from FIG. 19, when conditioning of the polishing pad 22 is not performed properly, the flatness of the polishing surface 22*a* is lost gradually over time.

Figure 20:
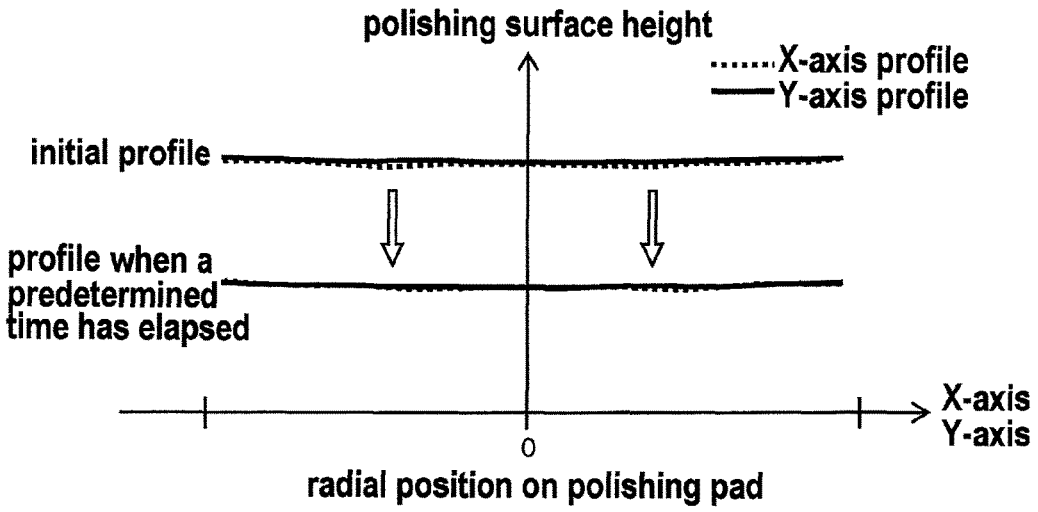
FIG. 20 is a diagram showing initial profiles and profiles obtained when a predetermined time has elapsed.
Figure 21:
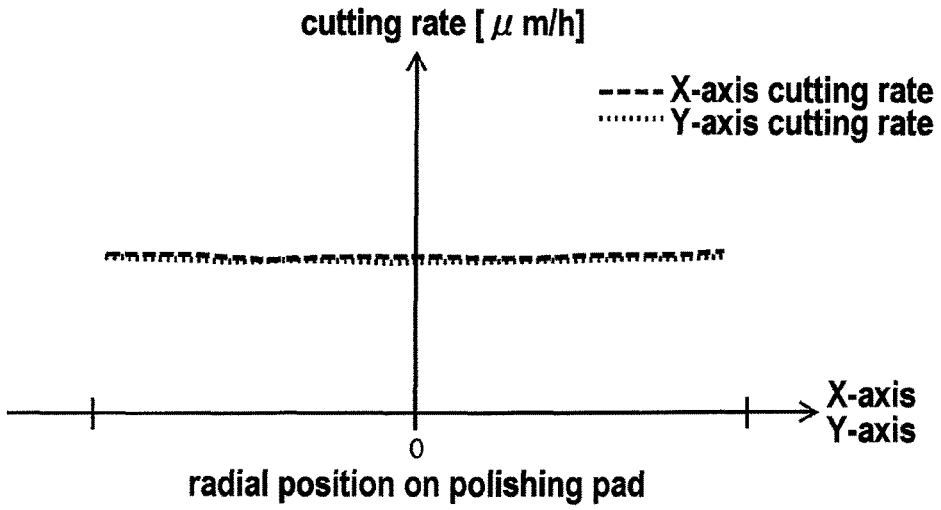
FIG. 21 is a diagram showing cutting rate determined from the profiles shown in FIG. 20.

The pad profile generator 95 further has a function to calculate X-axis cutting rate and Y-axis cutting rate of the polishing pad 22 from the X-axis profile and the Y-axis profile. FIG. 20 is a diagram showing initial profiles and profiles obtained when a predetermined time has elapsed, and FIG. 21 is a diagram showing the cutting rate determined from the profiles shown in FIG. 20. The X-axis cutting rate and the Y-axis cutting rate are determined by: retrieving from the pad profile memory 96 data on an initial X-axis profile and an initial Y-axis profile and data on the X-axis profile and the Y-axis profile obtained when the predetermined time has elapsed; calculating a difference in the height of the polishing surface 22*a* at corresponding position; and dividing the difference by the elapsed time.

As shown in FIG. 21, the X-axis cutting rate and the Y-axis cutting rate are plotted on a graph in which a vertical axis represents cutting rate and a horizontal axis represents radial position on the polishing pad. The X-axis cutting rate and the Y-axis cutting rate calculated by the pad profile generator 95 are displayed on the display device 86.

Figure 22:
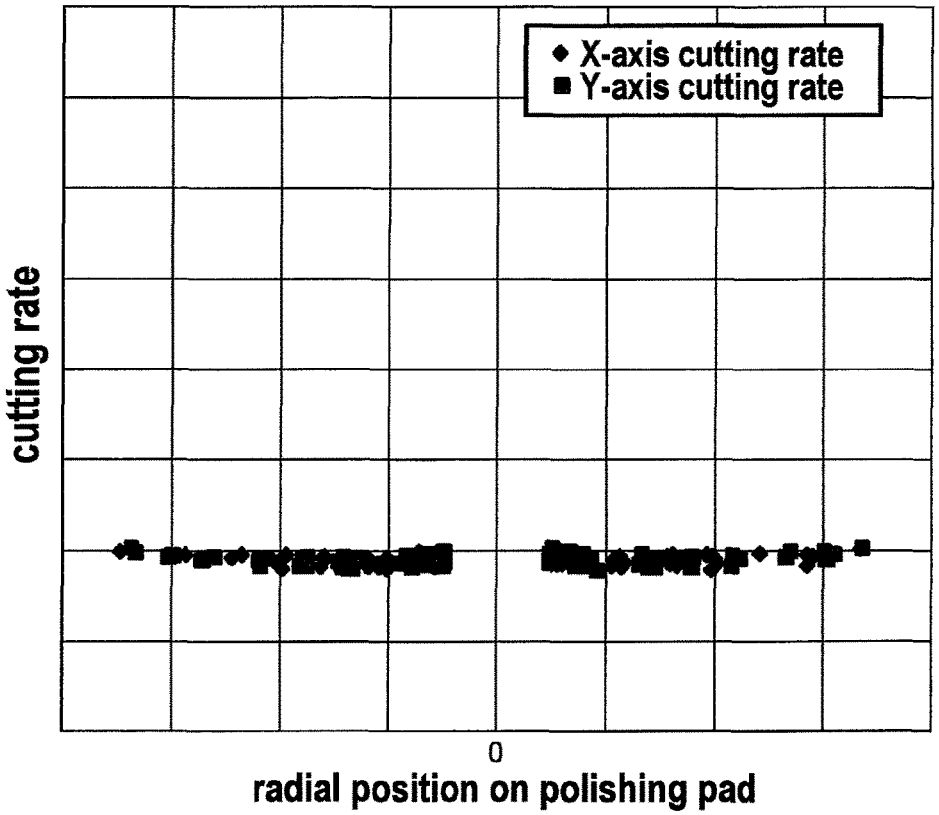
FIG. 22 is a diagram showing X-axis cutting rate and Y-axis cutting rate when conditioning of the polishing pad is performed properly.
Figure 23:
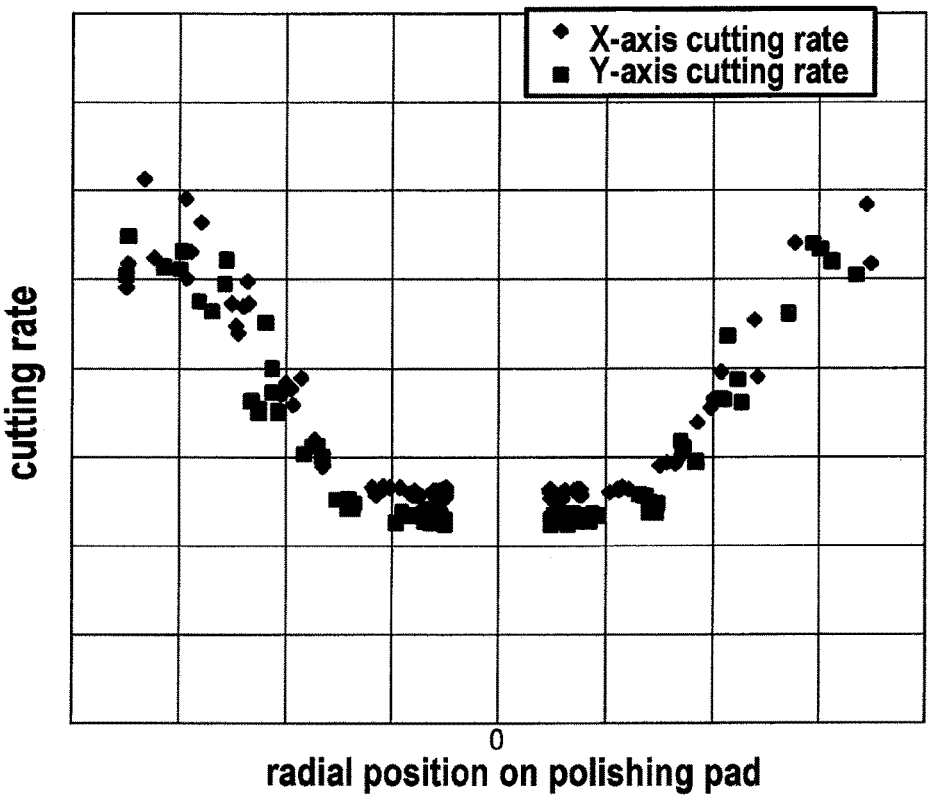
FIG. 23 is a diagram showing the X-axis cutting rate and the Y-axis cutting rate when conditioning of the polishing pad is not performed properly.

FIG. 22 is a diagram showing the X-axis cutting rate and the Y-axis cutting rate when conditioning of the polishing pad is performed properly. As can be seen from FIG. 22, when conditioning of the polishing pad is performed properly, a uniform cutting rate is obtained over the polishing surface 22*a* in its entirety. FIG. 23 is a diagram showing the X-axis cutting rate and the Y-axis cutting rate when conditioning of the polishing pad 22 is not performed properly. As can be seen from FIG. 23, when conditioning of the polishing pad is not performed properly, a uniform cutting rate is not obtained over the polishing surface 22*a* in its entirety.

According to the present invention, the profile and the cutting rate of the polishing pad 22 can be obtained during conditioning of the polishing pad 22. Therefore, recipe tuning of the pad conditioning can be carried out while monitoring the profile and/or the cutting rate. Further, it is not necessary to remove the polishing pad 22 from the polishing table 12 for obtaining the profile and the cutting rate of the polishing pad 22. Therefore, time and cost required for the recipe tuning can be reduced.

As shown in FIG. 2, conditioning of the polishing pad 22 is performed by rotating the dresser 50 about its own axis while oscillating the dresser 50 several times in the radial direction of the polishing surface 22*a*. Instead of this operation, it is possible to move the dresser 50 intermittently in the radial direction of the polishing surface 22*a* while rotating the dresser 50 about its own axis.

More specifically, the rotating dresser 50 is pressed against the polishing surface 22*a* in a certain position (a first or initial conditioning position) thereon, and the dresser 50 is held stationary in that position until the height of the polishing surface 22*a* is reduced to less than a target value. When the height of the polishing surface 22*a* is reduced to less than the target value, the dresser 50 is moved slightly in the radial direction of the polishing surface 22*a* to a second or subsequent conditioning position and then the dresser 50 is held stationary again until the height of the polishing surface 22*a* is reduced to less than the target value. By repeating these procedures, an entire region in the polishing surface 22*a* for use in polishing of the substrate can be conditioned.

In order to remove a measurement error of the polishing surface height right after the dresser 50 is moved, it is preferable to hold the dresser 50 stationary for at least a preset time. This preset time is preferably 120/N seconds, where N is the rotational speed ($min^{-1}$) of the polishing table 12. A distance of the intermittent movement of the dresser 50 is preferably about half a radius of the dresser 50.

Figure 24:
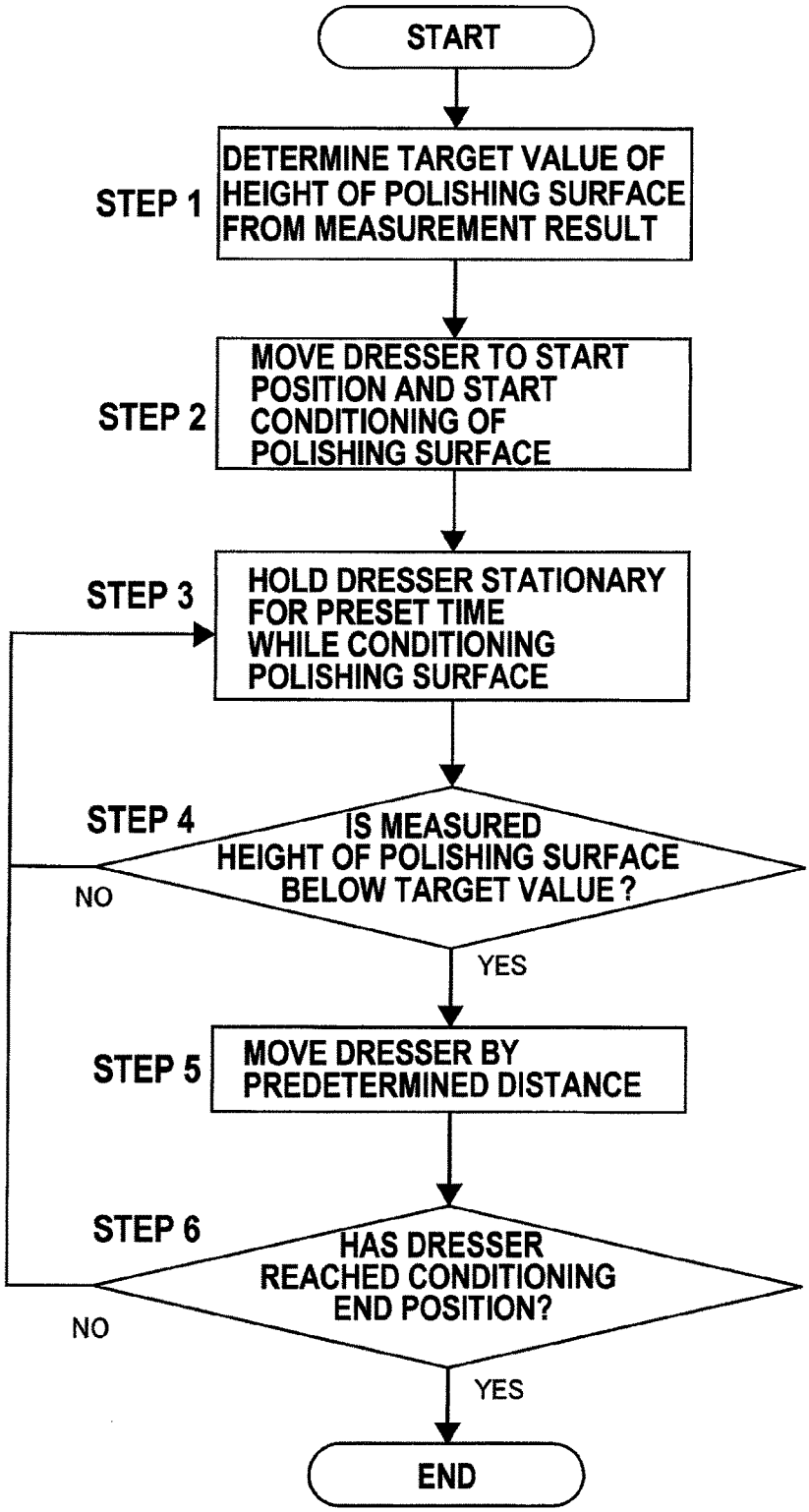
FIG. 24 is a flowchart explaining a conditioning method in which the dresser is moved intermittently.

FIG. 24 is a flowchart explaining a conditioning method in which the dresser 50 is moved intermittently. In step 1, the height of the polishing surface 22*a* in its entirety is measured, and a target value of the height of the polishing surface 22*a* is determined from the measurement result. In step 2, the dresser 50 is moved above the polishing surface 22*a*, and further the dresser 50 and the polishing pad 22 are rotated. In this state, the dresser 50 is lowered to press its lower surface (i.e., the dressing surface) against the polishing surface 22*a*.

In step 3, the rotating dresser 50 is held stationary in that first (or initial) conditioning position during the above-described preset time while pressing the polishing surface 22*a*. In step 4, it is judged whether or not the measured height of the polishing surface 22*a* is below the target value. In step 5, if the height of the polishing surface 22*a* is below the target value, then the dresser 50 is moved by a predetermined distance in the radial direction of the polishing pad 22 to the second (or subsequent) conditioning position. In step 6, it is judged whether or not the dresser 50 has reached a conditioning end position. If the dresser 50 has reached the conditioning end position, the conditioning process is terminated. If the dresser 50 does not reach the conditioning end position, the process goes back to the step 3.

In this method also, it is possible to determine the position of the dresser 50 on the two-dimensional surface defined on the polishing surface 22*a* and to determine the height of the polishing surface 22*a* corresponding to that position of the dresser 50. Therefore, the above-discussed monitoring method of the polishing surface 22*a* can be applied to this conditioning method.

The above-discussed polishing surface monitoring method can bring about the following beneficial results:

(i) Improvement of Product Yield

Because the irregularity detected points of the polishing surface height can be shown on the two-dimensional surface during conditioning of the polishing pad, polishing failure of the substrate is prevented.

(ii) Cost Reduction in the Polishing Pad

Because the service life of the polishing pad can be determined accurately from the irregularity detected points described on the two-dimensional surface, unnecessary replacement of the polishing pad is avoided.

(iii) Easy and Accurate Recipe Tuning of the Pad Conditioning

The profile and the cutting rate of the polishing pad can be monitored in real time based on the height of the polishing surface described on the two-dimensional surface. This makes it possible to judge whether the recipe is good or bad during pad conditioning.

Therefore, the time for the recipe tuning can be reduced. Furthermore, the accuracy of the recipe tuning can be improved because the recipe tuning can be performed based on the height of the polishing surface described on the two-dimensional surface.

(iv) Cost Reduction in the Recipe Tuning

The profile and the cutting rate of the polishing pad can be obtained without removing the polishing pad from the polishing table. Therefore, the cost of the recipe tuning can be reduced. Furthermore, an operating rate of the polishing apparatus can be improved.

(v) Reduction in Test Polishing

The profile of the polishing pad can be obtained even in test polishing. Therefore, polishing conditions can be adjusted during test polishing based on the profile of the polishing pad. As a result, the number of polishing tests can be reduced.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims and equivalents.

What is claimed is:

1. A method of monitoring a polishing surface of a polishing pad for use in a polishing apparatus, said method comprising:

conditioning the polishing surface of the polishing pad by placing a rotating dresser on the polishing surface at a first conditioning position while keeping a dresser arm stationary, the rotating dresser being mounted at a distal end of a vertically movable dresser shaft extending vertically from the dresser arm;

determining a height of the polishing surface including measuring a displacement of a sensor target with a pad height sensor during said conditioning while the dresser arm is stationary for at least a preset time, the pad height sensor being secured to the dresser arm, and the sensor target being secured to the dresser shaft and being vertically movable together with the dresser shaft;

judging whether or not the determined height is below a target value; and if the determined height is below the target value, moving the dresser arm until the dresser reaches a second conditioning position on the polishing pad.

2. The method according to claim 1, further comprising:

before said conditioning of the polishing surface, measuring the height of an entirety of the polishing surface; and determining the target value from a measurement result of the height of the entirety of the polishing surface.

3. The method according to claim 2, further comprising:

after the target value is determined, moving the dresser arm until the dresser is located at the first conditioning position above the polishing surface, wherein said conditioning comprises conditioning the polishing surface of the polishing pad by pressing the dresser against the polishing surface while rotating the polishing pad and the dresser.

4. The method according to claim 1, further comprising:

if the determined height is not below the target value, not moving the dresser arm while the rotating dresser keeps conditioning the polishing surface.

5. The method according to claim 1, further comprising:

after moving the dresser arm, judging whether or not the dresser has reached a preset conditioning end position on the dressing pad; and if the dresser has reached the preset conditioning end position, terminating conditioning of the polishing surface.

6. The method according to claim 5, further comprising:

if the dresser has not reached the preset conditioning end position, performing again said conditioning of the polishing surface for, said determining of the height of the polishing surface, and said judging whether or not the determined height is below the target value.

7. The method according to claim 1, wherein said determining of the height of the polishing surface comprises determining a height of the polishing surface at a measuring point while calculating a position of the measuring point on a two-dimensional surface defined on the polishing surface.

8. The method according to claim 1, wherein the sensor target is secured to the dresser shaft at a location between the rotating dresser and the dresser arm.

9. The method according to claim 1, wherein the pad height sensor and the sensor target are located above the polishing pad.

10. A polishing apparatus capable of conditioning a polishing surface of a polishing pad, said apparatus comprising:

a rotatable dresser configured to condition the polishing surface of the polishing pad when the dresser is placed on the polishing surface;

a dresser arm supporting the dresser and configured to move the dresser in a radial direction of the polishing pad;

a vertically movable dresser shaft extending vertically from the dresser arm, the rotatable dresser being mounted at a distal end of the dresser shaft;

a sensor target secured to the dresser shaft and movable vertically together with the dresser shaft;

a pad height sensor secured to the dresser arm and configured to determine a height of the polishing surface by performing a process including measuring a displacement of the sensor target while the dresser arm is stationary for at least a preset time; and a pad monitoring device configured to judge whether or not the determined height is below a target value; and a motor configured to move the dresser arm until the dresser reaches a subsequent conditioning position on the polishing pad if the pad monitoring device has judged that the determined height is below the target value.

11. The polishing apparatus according to claim 10, wherein the target value is determined from a measurement result of the height of an entirety of the polishing surface which is measured before the polishing surface is conditioned by the dresser.

12. The polishing apparatus according to claim 11, wherein:

the motor is configured to move the dresser arm until the dresser is located at an initial conditioning position above the polishing surface after the target value is determined; and the dresser is configured to rotate and press the polishing surface while the polishing pad is rotating to thereby condition the polishing surface of the polishing pad.

13. The polishing apparatus according to claim 10, wherein the motor is configured not to move the dresser arm while the dresser keeps conditioning of the polishing surface, if the pad monitoring device has judged that the determined height is not below the target value.

14. The polishing apparatus according to claim 10, wherein the dresser is configured to terminate conditioning of the polishing surface if the dresser has reached a preset conditioning end position on the polishing pad.

15. The polishing apparatus according to claim 14, wherein if the dresser has not reached the preset conditioning end position, the dresser conditions the polishing surface again, the pad height sensor measures the height of the polishing surface again, and the pad monitoring device judges whether or not the determined height is below the target value again.

16. The polishing apparatus according to claim 10, wherein the pad height sensor determines the height of the polishing surface at a measuring point while the pad monitoring device calculates a position of the measuring point on a two-dimensional surface defined on the polishing surface.

17. The polishing apparatus according to claim 10, wherein the sensor target is secured to the dresser shaft at a location between the rotating dresser and the dresser arm.

18. The polishing apparatus according to claim 10, wherein the pad height sensor and the sensor target are to be located above the polishing pad.

19. A method of monitoring a polishing surface of a polishing pad for use in a polishing apparatus, said method comprising:

conditioning the polishing surface of the polishing pad by placing a rotating dresser on the polishing surface at a first conditioning position while keeping a dresser arm stationary, the rotating dresser being mounted at a distal end of a vertically movable dresser shaft extending vertically from the dresser arm;

determining a vertical position of the polishing surface including measuring a displacement of a sensor target with a displacement sensor during said conditioning while the dresser arm is stationary for at least a preset time, the displacement sensor being secured to the dresser arm, and the sensor target being secured to the dresser shaft and being vertically movable together with the dresser shaft;

judging whether or not the determined vertical position is below a target value; and if the determined vertical position is below the target value, moving the dresser arm until the dresser reaches a second conditioning position on the polishing pad.

* * * * *